US008683906B2

(12) United States Patent
Baxter et al.

(10) Patent No.: US 8,683,906 B2
(45) Date of Patent: Apr. 1, 2014

(54) AMMUNITION LOADER

(75) Inventors: Timothy R. Baxter, South Beloit, IL (US); Emery Johnson, Rockton, IL (US)

(73) Assignee: Dixon Automatic Tool, Inc., Rockford, IL (US)

( * ) Notice: Subject to any disclaimer, the term of this patent is extended or adjusted under 35 U.S.C. 154(b) by 7 days.

(21) Appl. No.: 13/312,458

(22) Filed: Dec. 6, 2011

(65) Prior Publication Data

US 2013/0139675 A1 Jun. 6, 2013

(51) Int. Cl.
*F42B 33/02* (2006.01)

(52) U.S. Cl.
USPC ..... 86/31; 86/23

(58) Field of Classification Search
USPC ..... 86/31, 23, 25, 26, 29
See application file for complete search history.

(56) References Cited

U.S. PATENT DOCUMENTS 3,656,517 A * 4/1972 Taylor et al. ..... 141/1
4,020,737 A * 5/1977 Ransom ..... 86/23
6,772,668 B2 * 8/2004 Shields ..... 86/31

* cited by examiner

*Primary Examiner* — James Bergin
(74) *Attorney, Agent, or Firm* — Reinhart Boerner Van Deuren P.C.

(57) ABSTRACT

A ammunition loading machine is provided. The ammunition loading machine includes a base frame. A rake assembly is mounted to the base frame and configured to index a linear row of cases along a first linear axis. A platen assembly is also mounted to the base frame and is movable relative to the base frame along a second linear axis that is orthogonal to the first linear axis. A propellant hopper is fixedly mounted to the base frame. The platen assembly is movable relative to the propellant hopper to transfer propellant from the propellant hopper to a propellant filling mechanism that is movable with the platen assembly. The rake assembly is adjustable to accommodate multiple different sizes of cartridges. The rake assembly and platen assembly are commonly linked to a cam drive mechanism for simultaneously moving the rake assembly and the platen assembly.

10 Claims, 18 Drawing Sheets

AMMUNITION LOADER

FIELD OF THE INVENTION

This invention generally relates to ammunition manufacturing equipment, and more particularly to high speed ammunition preparation and loading machines.

BACKGROUND OF THE INVENTION

Government agencies and shooting enthusiasts alike have shown an increasing demand for ammunition in recent years. As a result, ammunition manufacturers have been under increasing pressure to produce a greater output in a relatively short amount of time.

Conventional ammunition manufacturing machines have remained generally unchanged since their acceptance into the industry. The ammunition loading machine is no exception. The ammunition loading machine is used for the manufacture of cartridges ranging from pistol to rifle calibers. In short, this machine attaches a primer to a brass case, fills the brass case with a propellant, and places a projectile into the brass case. As such, the ammunition loading machine takes a separate brass case, a primer, a propellant, and a projectile as inputs and produces a fully functional cartridge as an output.

A typical ammunition loading machine moves the brass case through a plurality of side-by-side stations until it is ultimately joined with a projectile. Each station performs a different function and thus the stations can generally be thought of as an assembly line. As the brass case moves through this line, various operations are performed including primer insertion, propellant filling, projectile attachment, as well as various quality and safety checks.

The aforementioned stations are typically mounted in a linear row with a vertically oscillating platen. The brass cases are arranged in a linear row below the platen, and below each station. The platen is vertically movable up and down relative to the row of brass cases. When the platen is at the bottom of its downward stroke, the stations are in contact with the row of brass cases, and each station performs its respective operation on the brass case aligned with that particular station. When the platen moves upward and away from the row of brass cases, the brass cases are indexed linearly so that each brass case moves from under the station that just completed its operation on that case to under the next adjacent station. The downward stroke of the platen then repeats, and the next operation for each brass case is performed. This process repeats as each brass case moves from station to station until a completed cartridge is ultimately ejected from the ammunition loading machine.

The above described operation is continuous. That is, there are hoppers mounted to the machine that carry empty brass cases, primers, propellant, and projectiles. These hoppers provide a continuous supply of the items required to manufacture a completed cartridge. Loading operations will terminate when one or more hopper runs out of material, or when a predetermined amount of a particular size caliber has been produced.

The inventors herein have discovered several shortcomings with above described conventional ammunition loading machines. First, the propellant hopper is fixedly attached to the oscillating platen such that it oscillates therewith. Such oscillation can cause compaction of the propellant that can in turn lead to incorrect and/or inconsistent propellant fills during the manufacture of the cartridge. Additionally, mounting the propellant hopper to the oscillating platen also requires moving the additional weight of the filled hopper during the oscillation of the platen. This increases the overall power requirements of the machine.

Second, the linear row of brass cases are ordinarily indexed from station to station by a rake assembly. The rake assembly is typically designed to operate with a single or select few caliber sizes, and must be changed out in order to manufacture a different caliber size. Thus, the setup time between production runs of different calibers is increased.

Third, the above described machines do not provide for a quality check on each brass case to, inter alia, ensure that the brass case has been filled with the correct amount of propellant. Instead, random sampling is employed on a select number of completed cartridges as a quality check. This can lead to certain cartridges of a completed lot being incorrectly filled, thereby causing misfires in the field.

Fourth, the above described machines typically employ separate drive systems for oscillating the platen and for indexing the linear row of brass cases. These drive systems must be carefully synchronized to ensure the proper operation of the machine. Such synchronization requires additional control methodologies that drive up the overall cost and complexity of the machine. Such a cost and complexity increase is beyond the already relatively heightened cost and complexity caused by utilizing two entirely separate drive mechanisms.

With the above described configuration of a typical ammunition loading machine in mind, there is a need in the art for an improved configuration that can meet the current demands for large volume output of ammunition. The invention provides such a configuration. These and other advantages of the invention, as well as additional inventive features, will be apparent from the description of the invention provided herein.

BRIEF SUMMARY OF THE INVENTION

In one aspect, an ammunition loading machine is provided. The ammunition loading machine includes a base frame. A rake assembly is mounted to the base frame and moveable relative to the base frame along a first and a second axis. A platen assembly is mounted to the base frame and moveable relative to the base frame along a third axis orthoganol to the first and second axis. A drive arrangement is mounted to the base frame. The drive arrangement includes a drive shaft. Each of the rake assembly and platen assembly are mechanically coupled to the drive shaft for movement along the respective first, second, and third axes.

The drive shaft includes first, second, and third cam arrangements. The first cam arrangement is mechanically coupled to the rake assembly. The second cam arrangement is mechanically coupled to the platen assembly. The third cam arrangement is mechanically coupled to the rake assembly.

The first cam arrangement includes a barrel cam. The barrel cam has a follower groove formed in a radial face of the barrel cam. The first cam arrangement includes a reciprocating arm. The reciprocating arm includes a cam follower extending into the follower groove. The reciprocating arm is pivotably mounted the base frame such that the reciprocating arm pivots to linearly reciprocate the rake assembly along the first axis as the barrel cam rotates.

The second cam arrangement includes a face cam. The face cam has a follower groove formed in an axial face of the face cam. The second cam arrangement includes a reciprocating arm. The reciprocating arm includes a cam follower extending into the follower groove. The reciprocating arm is mounted to a pivot such that the reciprocating arm pivots to linearly reciprocate the platen assembly along the third axis as the face cam rotates. The reciprocating arm is mechanically coupled to a biasing arrangement for biasing the reciprocating arm along the third axis.

The third cam arrangement includes a face cam. The face cam has a follower groove formed in an axial face of the face cam. The third cam arrangement includes a reciprocating arm. The reciprocating arm includes a cam follower extending into the follower groove. The reciprocating arm is mounted to a pivot such that the reciprocating arm pivots to linearly reciprocate the rake assembly along the second axis as the face cam rotates.

The reciprocating arm is coupled to a linkage block. The linkage block is connected to an underside of a bottom plate of the platen assembly. The linkage block is interchangeable to modify a stroke length of the platen assembly.

The first cam arrangement includes a barrel cam mounted to a drive shaft. The second cam arrangement includes a face cam mounted to the drive shaft. The third cam arrangement includes a face cam mounted to the drive shaft. The face cam of the second cam arrangement is interposed between the barrel cam and the face cam of the third cam arrangement along the drive shaft.

The drive shaft is coupled for rotation to a motor. Rotation of the drive shaft produces a commensurate rotation in each of the barrel cam, face cam of the second cam arrangement, and face cam of the third cam arrangement.

In another aspect, an ammunition loading machine is provided. An ammunition loading machine according to this aspect includes a base frame. A platen assembly is moveable relative to the base frame along a longitudinal platen axis. A stationary propellant hopper is fixedly mounted to the base frame and configured for carrying and supplying propellant to a propellant filling mechanism on the platen assembly. The platen assembly is moveable relative to the stationary propellant hopper such that the platen assembly is configured to transfer propellant from the stationary propellant hopper to a propellant filling mechanism on the platen assembly.

The platen assembly includes a propellant filling station. The propellant filling station includes a propellant tube. The propellant tube includes a first end extending into a funnel of the stationary propellant hopper through an opening of the funnel. A second end is positioned adjacent a measuring cylinder of the propellant filling station. The propellant tube oscillates parallel to the platen axis within the opening of the funnel.

In certain embodiments, the second end of the propellant tube includes a plurality of tines separated by gaps.

In certain embodiments, the ammunition loading machine also includes an L-shaped mounting arm for mounting the stationary propellant hopper to the base frame and above the propellant filling station.

In certain embodiments, the ammunition loading machine also includes a first weighing station and a second weighing station positioned on the base frame. The first weighing station is positioned on one side of the propellant filling station. The second weighing station is positioned on another side of the propellant filling station such that a weight measurement is taken before and after propellant is dispensed from the propellant hopper.

In yet another aspect, an ammunition loading machine is provided. The ammunition loading machine includes a base frame. A rake assembly is mounted to the base frame and moveable along a first and a second axis. The first and second axes are orthogonal and coplanar. The rake assembly comprises a first and a second bar arrangement. The first bar arrangement is moveable relative to the second bar arrangement to index a linear row of cases relative to the base frame along the first axis. The second bar arrangement is adjustable along the second axis to vary a minimum distance between a peripheral edge of the first bar arrangement and a peripheral edge of the second bar arrangement.

The first bar arrangement is moveable relative to the second bar arrangement in a reciprocating cycle such that the first bar arrangement is at the minimum distance at one portion of the reciprocating cycle and not at the minimum distance at another portion of the reciprocating cycle.

The first bar arrangement includes a rake, an upper arm, and a lower arm. The upper arm is mounted on top of the lower arm. The rake is mounted on top of the upper arm. The upper arm possesses two degrees of freedom relative to the base frame. The lower arm possesses a single degree of freedom relative to the base frame.

The second bar arrangement includes a base and a blade. The blade is mounted on top of the base and is adjustable relative to the base. Each of the blade and base have a plurality of adjustment apertures. Select ones of the plurality of adjustment apertures of the blade are alignable with select one of the plurality of adjustment apertures of the base to define a plurality of discrete adjustment positions.

In certain embodiments, the ammunition loading machine according to this aspect includes at least one biasing mechanism mounted between the blade and the base. The at least one biasing mechanism is operable to bias the blade relative to the base along the second axis.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, there is illustrated an exemplary embodiment of an ammunition loading machine 30 (hereinafter "the machine 30") according to the teachings of the instant invention. The machine 30 incorporates a new and improved propellant hopper arrangement that eliminates the oscillating propellant hopper of prior designs. The machine 30 also includes a universal rake assembly that utilizes a single rake configuration to accommodate various case sizes and thus multiple calibers can be made in a single set up using the machine 30. Further, the machine 30 also incorporates a plurality of weighing stations to verify that each cartridge made by the machine 30 is within its desired specifications. The machine 30 also incorporates a new and improved drive arrangement that utilizes a single drive shaft to vertically reciprocate a platen assembly of the machine 30 as well as linearly move the rake assembly of the machine 30 without the necessity of utilizing separate drive mechanisms unlike prior designs. These features as well as other advantages of embodiments of the instant invention will be described in greater detail below.

Figure 1:
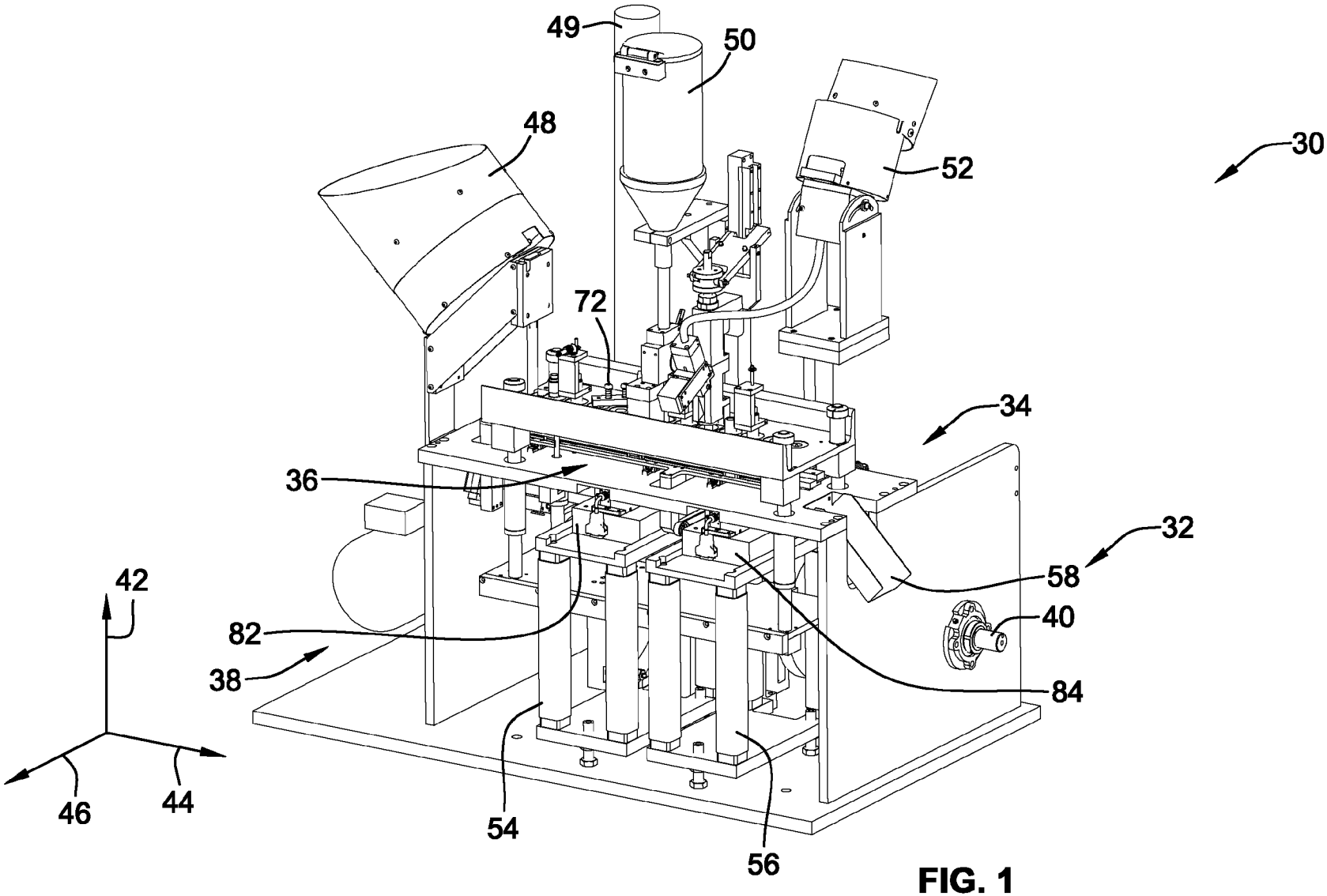
FIG. 1 is a perspective view of an exemplary embodiment of an ammunition loading machine according to the teachings of the present invention.

With particular reference to FIG. 1, an exemplary embodiment of the machine 30 is illustrated. The machine 30 incorporates a base frame 32 that is generally a box like structure. A platen assembly 34 is mounted for oscillation relative to the base frame 32. A rake assembly 36 is also mounted to the base frame 32 on a table top 68 thereof and beneath the platen assembly 34.

A drive arrangement 38 is also mounted to the base frame 32. The drive arrangement 38 includes a universal drive shaft 40. The drive shaft 40 is responsible for vertically oscillating the platen assembly 34 in a vertical direction parallel to a first reference axis 42 as illustrated. The drive shaft 40 is also responsible for moving the rake assembly 36 in a plane defined by second and third reference axes 44, 46 that are orthogonal to one another as well as orthogonal to the first reference axis 42. As will be explained in greater detail below, utilizing a single drive shaft 40 to achieve the desired reciprocation of the platen assembly 34 and rake assembly 36 advantageously eliminates the need for additional drive mechanisms unlike prior designs.

Also mounted to the base frame 32 are a plurality of hoppers used to supply the various materials required to form a usable cartridge of ammunition. More specifically, a case hopper 48 is mounted approximate one end of the rake assembly 36 and is responsible for supplying the rake assembly with empty cases (see also FIG. 2). A stationary propellant hopper 50 is also mounted to the base frame 32 and provides propellant to the empty cases supplied by the case hopper 48. A projectile hopper 52 is also mounted to the base frame 32 and is responsible for supplying projectiles to the cases after being filled with propellant from the propellant hopper 50. From the above, it will be recognized that the cases supplied by the case hopper 48 move from left to right in FIG. 1 and generally parallel to the second reference axis 44. Once each cartridge is completely assembled, the same is ejected from a chute 58 connected to the base frame 32 and aligned with the rake assembly 36. As used herein, the term "case" is used to refer to a brass case as it progresses through the various stations. The term "cartridge" is used to refer to the combination of a case, a primer, propellant, and a projectile that is ready for service, (i.e. has completed all stations).

A pair of weighing stations 54, 56 are also on the base frame 32. The left most weighing station 54 in FIG. 1 is responsible for weighing an empty case received from the case hopper 48 prior to being filled with any propellant from the propellant hopper 50 or receiving a projectile from the projectile hopper 52. The right most weighing station 56 is positioned to take a post fill reading of a cartridge once it has been filled with propellant from the propellant hopper 50 and has received a projectile from the projectile hopper 52. The machine 30 is operably coupled to a controller (not shown) that analyzes the readings taken from the weighing stations 54, 56. The controller is programmed with a known tolerance of the difference between an unfilled case and a completed cartridge. As such, in the event the control detects that a cartridge does not fall within this tolerance band, the same is ejected from the machine 30 so as to not comingle with the completed cartridges that are within this tolerance band.

Each weighing station 54, 56 includes scale 82, 84. These scales 82, 84 extend into apertures 86, 88 of the table top 68 of the machine 30. Each case 60 is brought into contact with each weighing station 82, 84 by virtue of the weighing stations 82, 84 extension through the apertures 86, 88. As a result, a pre and post fill weight measurement are taken for each case 60. Such a configuration advantageously overcomes existing designs by performing a weight based quality check on every case 60 processed by the machine 30.

Figure 2:
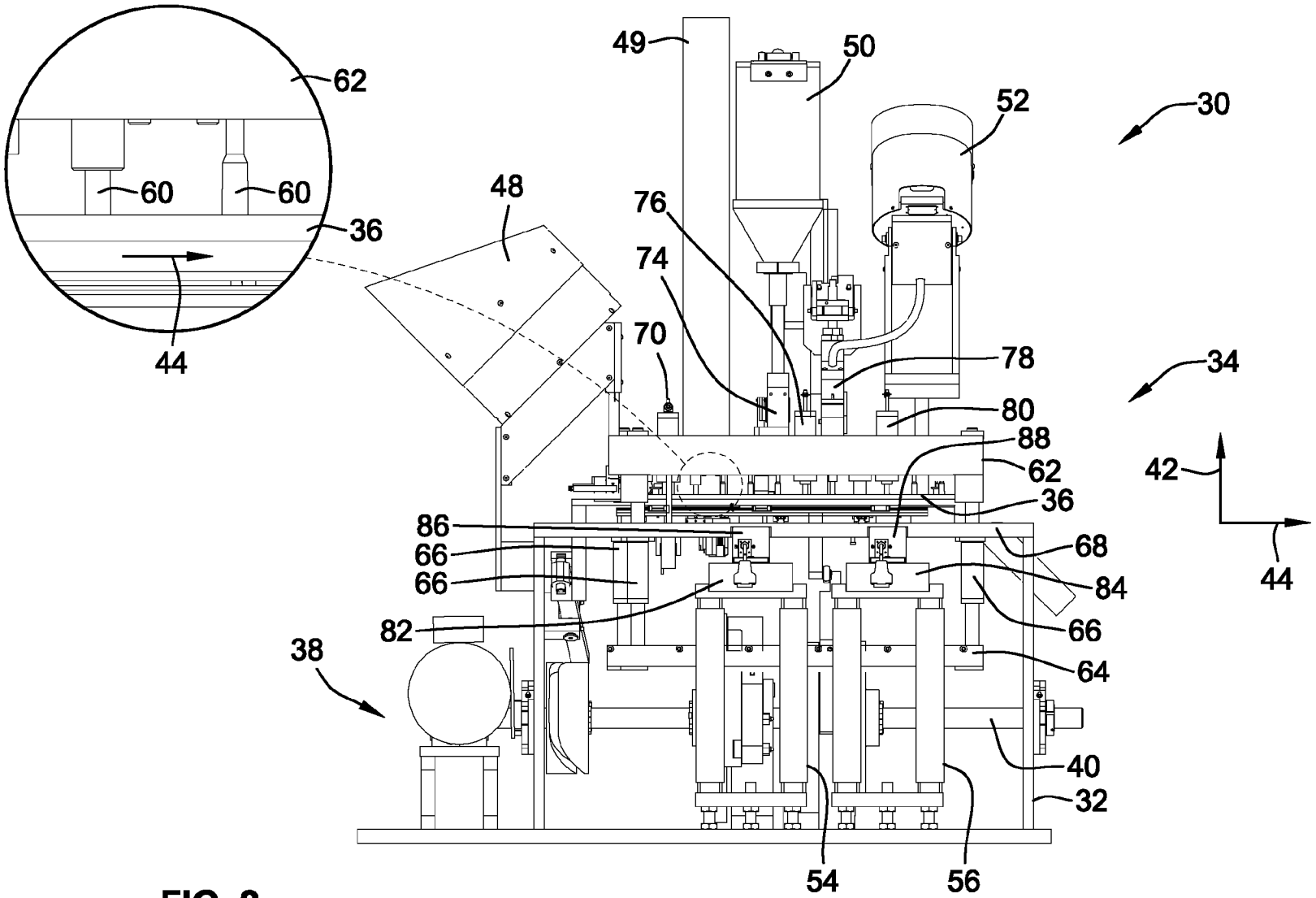
FIG. 2 is a front view of the ammunition loading machine of FIG. 1.

Turning now to FIG. 2, the platen assembly 34 will be described in greater detail. The platen assembly 34 includes a top plate 62 and a bottom plate 64. A plurality of supports 66 extend between the top and bottom plates 62, 64 and through the table top 68 such that the table top 68 is interposed between the plates 62, 64. The supports 66 are rigid such that the spacing between the top plate 62 and bottom plate 64 remains constant.

As will be described in greater detail below, the bottom plate 64 is mechanically coupled to the drive shaft 40 such that the same will oscillate along an axis parallel to the first reference axis 42 when the drive shaft 40 rotates. Due to the aforementioned rigid connection provided by the supports 66, the top plate 62 will undergo a like oscillation. When the platen assembly 34 is on its upward stroke, the rake assembly 36 indexes each case 60 from its current station or position relative to the base frame 32 and platen assembly 34, to the next adjacent station along a direction parallel to the second reference axis 44. When the platen assembly 34 is at the bottom of its downward stroke, each station is in contact with its respective case 60 and performs its respective operation thereupon. By non-limiting example, the various stations can include a flash hole verification station 70, a priming station 72 (see FIG. 1), a propellant filling station 74, a propellant height verification station 76, a projectile loading station 78, and a projectile verification station 80. The order and type of stations are largely determined by the user, and thus the previous list is non-exhaustive.

Each of the aforementioned stations are mounted upon the top plate 62 of the platen assembly 34. As a result, these stations linearly reciprocate with the platen assembly 34. However, the propellant filling station 74 does not include a moveable hopper unlike prior designs. Instead, the propellant filling station 74 draws propellant from the stationary propellant hopper 50 introduced above.

Figure 3:
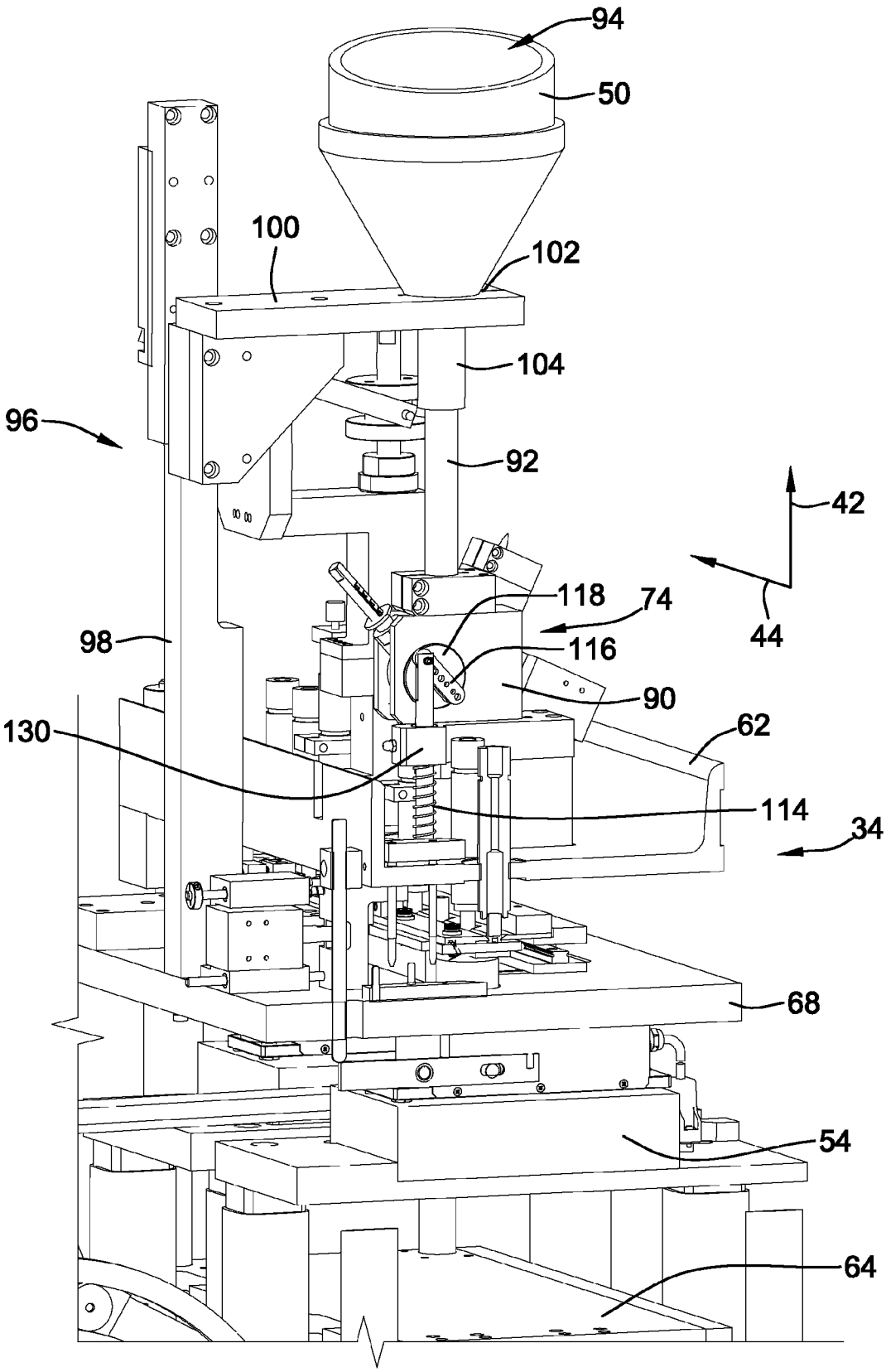
FIGS. 3-6 are perspective partial views of a propellant filling station and propellant hopper of the ammunition loading machine of FIG. 1.

With reference now to FIG. 3, the aforementioned stationary configuration of the propellant hopper 50 will be described in greater detail. The propellant filling station 74 includes a propellant delivery mechanism 90 that facilitates graduated propellant metering. The propellant delivery mechanism 90 includes a propellant tube 92. The propellant delivery mechanism 90 as well as its associated propellant tube 92 oscillate with the platen assembly 34 given their fixed connection to the top plate 62. Such oscillation causes the propellant tube 92 to oscillate into and out of a containment region 94 of the propellant hopper 50 that carries propellant.

The stationary propellant hopper 50 is held in an elevated position above the platen assembly 34 by way of a mounting arm 96. The mounting arm 96 includes a first member 98 that is mounted to the table top 68 and extends upwardly therefrom. The mounting arm 96 also includes a second member 100 that extends in a cantilever fashion from the first member 98. The second member 100 includes an opening 102 therethrough for receipt of a funnel 104 of the propellant hopper 50. As illustrated, the propellant tube 92 extends into the funnel 104 to draw propellant from the containment region 94 of the propellant hopper 50.

Figure 4:
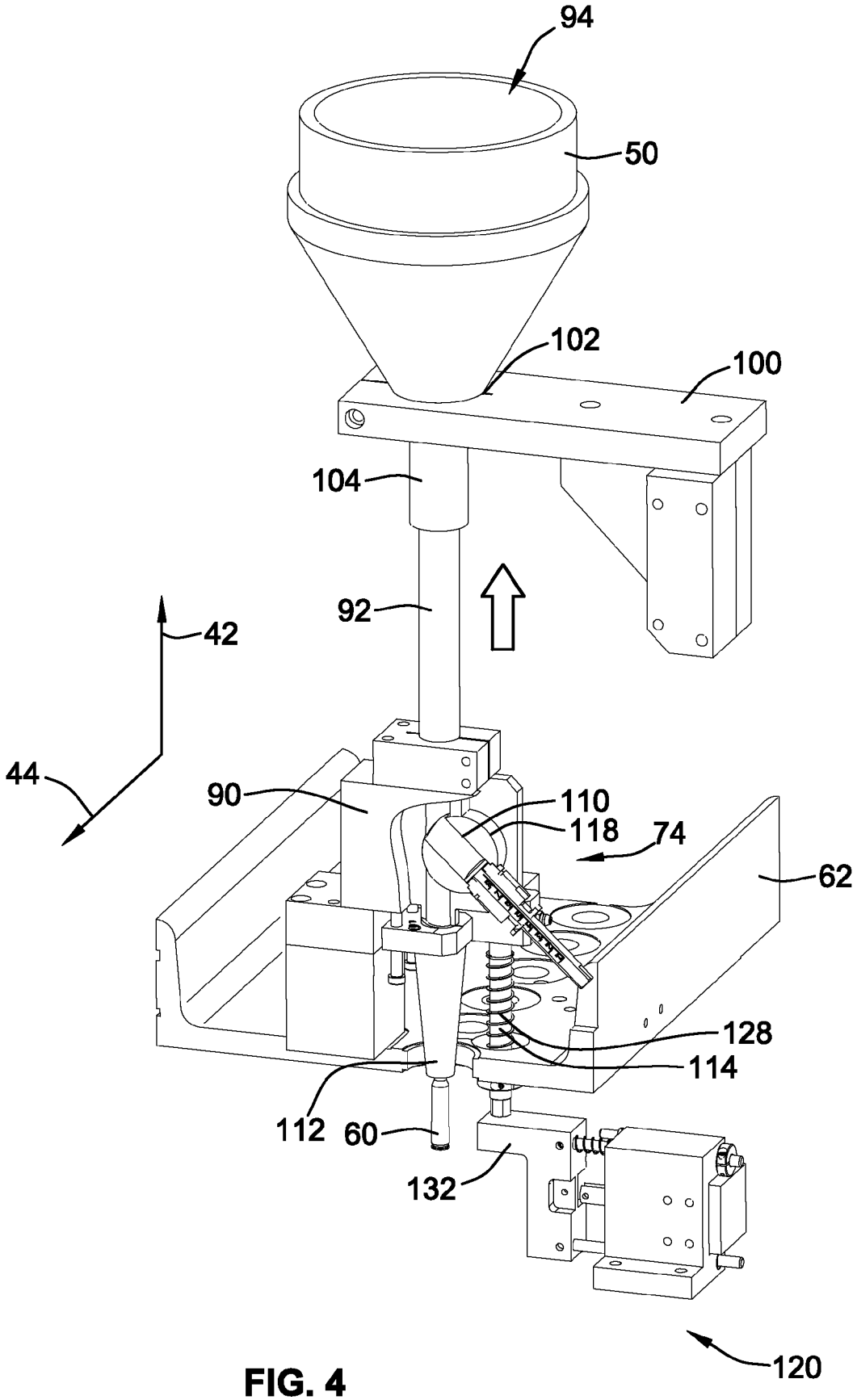

When the platen assembly, and more particularly the top plate 62, is at the top of its upward stroke, propellant passes from the containment region 94 of the stationary propellant hopper 50 through the propellant tube 92, and into a precision volume measuring cylinder 110 as illustrated at FIG. 4. As illustrated in FIG. 4, the propellant filling station 74 also includes a filling funnel 112 which is generally aligned above a case 60 as illustrated. As the platen assembly 34, and more particularly, the top plate 62, begin movement in the downward stroke, an abutment arm 114 will positively abut a stopcam follower mechanism 116. Referring momentarily back to FIG. 3, the abutment arm 114 is mechanically linked to a rocker arm 116 of the propellant delivery mechanism 90. The rocker arm 116 is longitudinally aligned with the longitudinal fill axis of the measuring cylinder 110. More specifically, the rocker arm 116 is fixedly mounted to a carrying cylinder 118 that carries the precision measuring cylinder 110. The carrying cylinder 118 is rotatable about its center axis relative to the remainder of the propellant filling mechanism 90.

As such, and referring now back to FIG. 4, rotation of the rocker arm 116 and carrying cylinder 118 causes the measuring cylinder to rotate in a counter-clockwise direction relative to FIG. 4 and away from the propellant tube 92 and towards the filling funnel 112. Such rotation causes the propellant contained in the measuring cylinder 110 to be transferred to the filling funnel 112 and ultimately to case 60.

Figure 5:
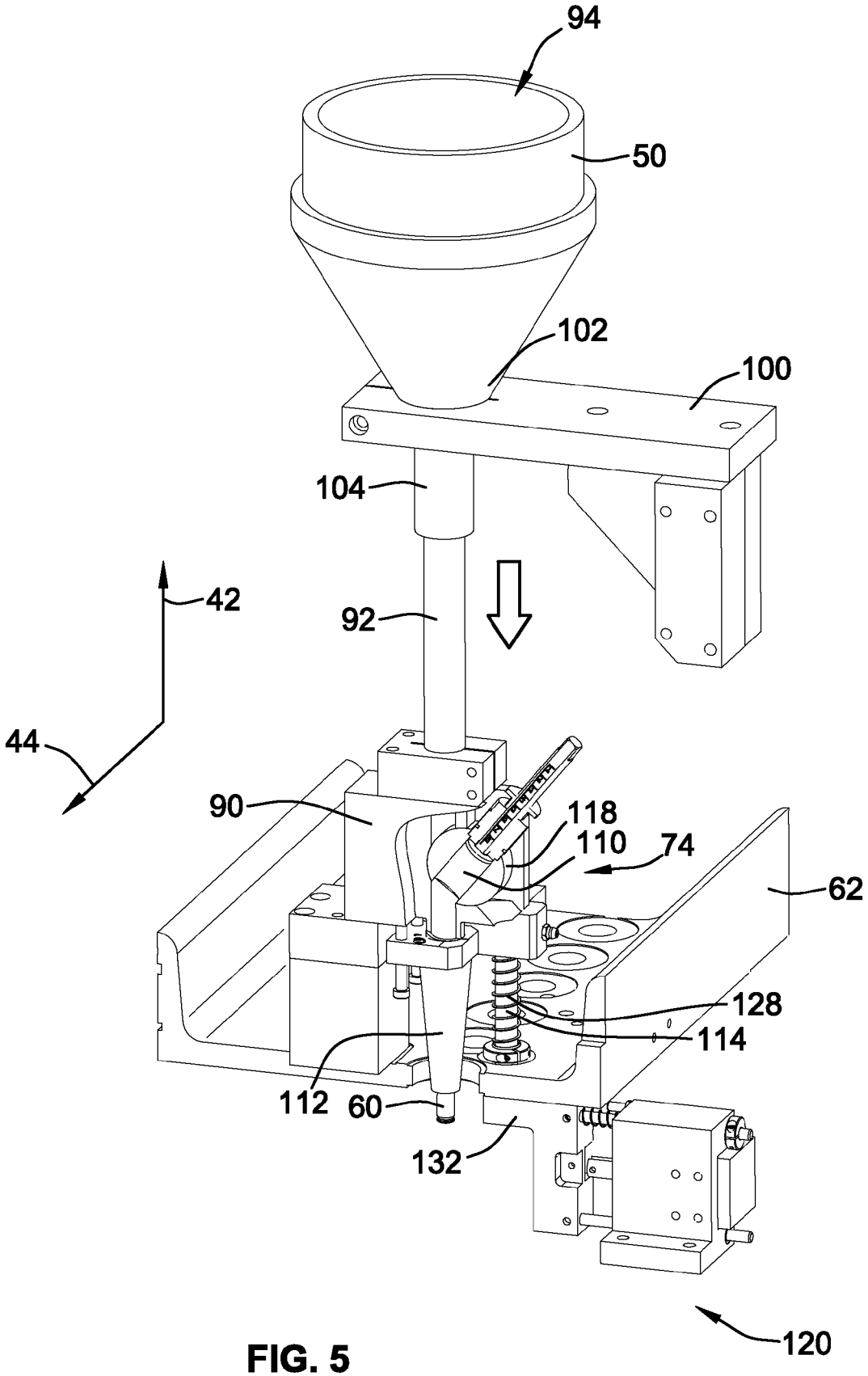

With reference now to FIG. 5, the platen assembly 34 and more particularly the top plate 62 thereof, are shown at the bottom of its downward stroke. As illustrated, the abutment arm 114 with the stopcam follower mechanism 120 has rotated the rocker arm 116 (see FIG. 3) and the measuring cylinder 110 counter-clockwise to transfer the propellant contained in the measuring cylinder 110 through the filling funnel 112 to the case 60 as illustrated. The abutment arm 114 also includes a return spring 128 that is compressed against a shoulder block 130 (see FIG. 3) as the top plate 62 moves in the downward direction on the downward stroke. The return spring 128 operates to return the abutment arm 114 and the rocker arm 116 to their configuration as illustrated in FIG. 4 at the upward stroke. It will be recognized that such operation reorients the measuring cylinder 110 from the funnel 112 back to the propellant tube 92 to receive a subsequent amount of propellant from the containment region 94 of the stationary propellant hopper 50.

Figure 6:
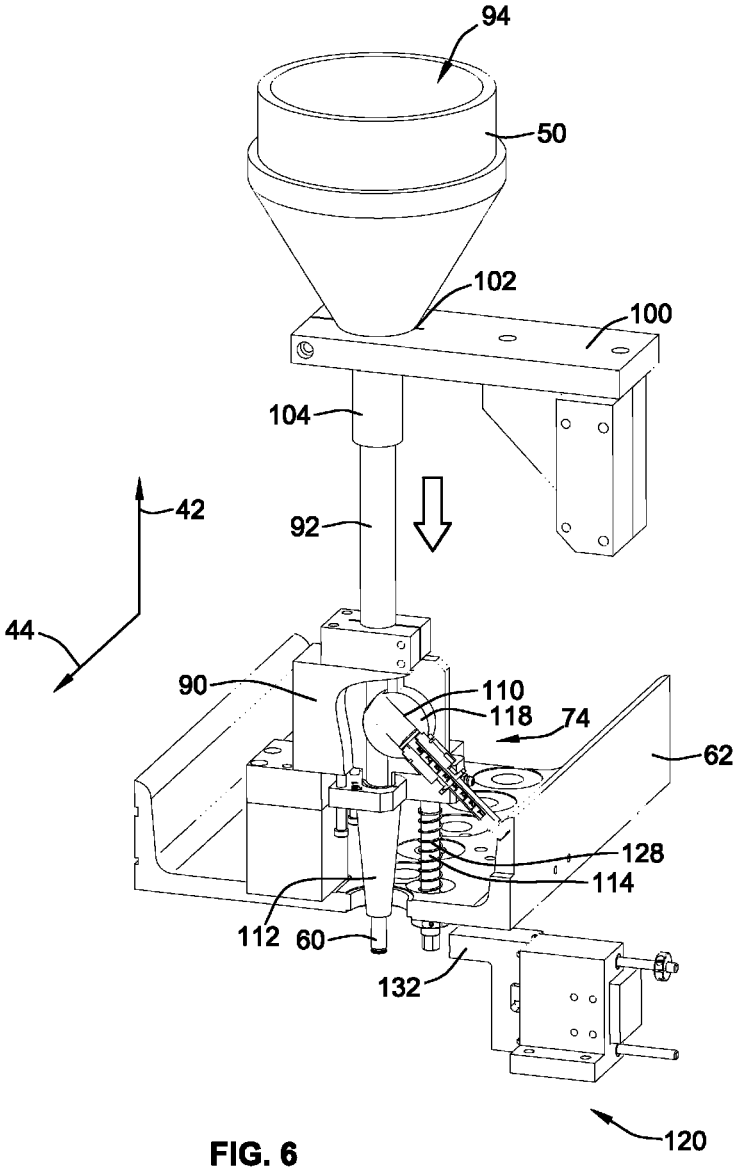

Turning now to FIG. 6, the above described operation of the propellant filling mechanism 90 will repeat for each reciprocation cycle of the platen assembly 34. That is, the measuring cylinder 110 will rotate to receive propellant from the propellant tube 92 during the upward stroke, rotate counter-clockwise to align with the filling funnel 112 to transfer the propellant therein to the case 60, and rotate clockwise to return to alignment with the propellant tube 92 on the next subsequent upward stroke. However, in the event that the machine 30 detects by way of an upstream inspection station that the particular case 60 is out of specification, the stopcam follower mechanism 120 will operate to prevent propellant from being transferred from the measuring cylinder 110 to the case 60.

More specifically, certain abnormalities in the case 60 may be present, e.g. foreign material inside the case, a dent in the case, or some other deformation thereof, which will be detected by an upstream inspection as introduced above. As such, such a case 60 will not be useable for a completed cartridge, and thus to fill the same with any propellant would be a waste of this material. To prevent this, once an abnormality is detected, the stopcam follower mechanism 120 will retract a stopcam follower block 132 thereof by way of an electrically actuated solenoid or the like to bring the same out of any abutment with the abutment arm 114. Because the abutment arm will not contact the stopcam follower block 132, the carrying cylinder 118 and measuring cylinder 110 will not rotate. Put differently, the abutment arm 114 will not move linearly upward relative to the rocker arm 116 (see FIG. 3) and thus will not cause the rocker arm 116 to rotate. As a result, no propellant will be transferred to the measuring cylinder 110 to the case 60 containing the abnormality. When the top plate 62 moves upward again on the next upward stroke, the stopcam follower mechanism 120 will return the shoulder block 130 to its normal configuration or position as illustrated at FIGS. 4 and 5.

Figure 7:
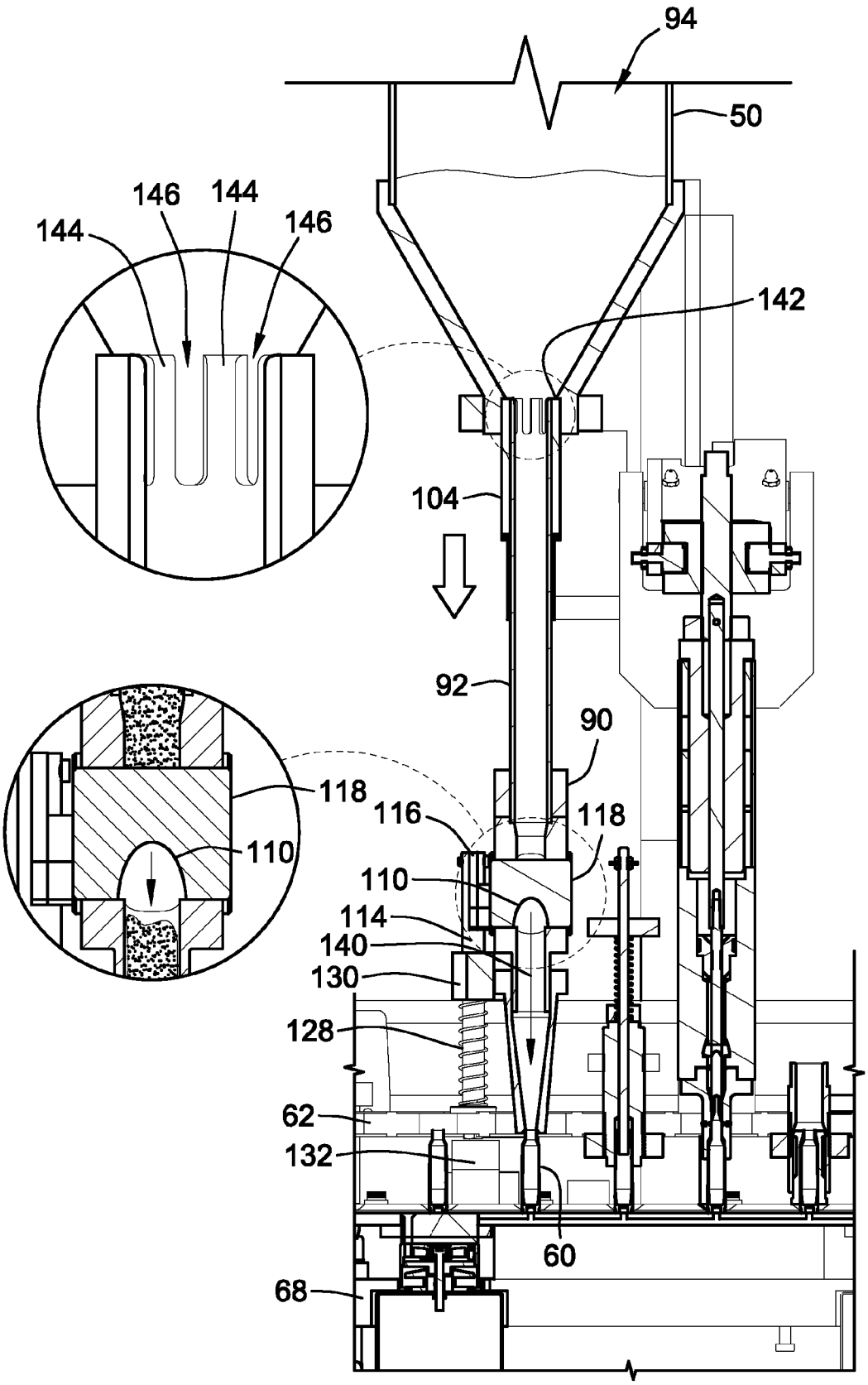
FIGS. 7 and 8 are front partial cross sections of the propellant filling station and propellant hopper of FIGS. 3-6.

Turning now to FIG. 7, the top plate 62 is illustrated during the downward stroke. As illustrated, the measuring cylinder 110 is aligned with the filling funnel 112 such that propellant will pass from the measuring cylinder 110 to the case 60 in direction 140 as illustrated. Also illustrated at FIG. 7, the propellant tube 92 is positioned within the funnel 104 of the propellant hopper 50 at an entrance 142 of the containment region 94. The end of the propellant tube 92 positioned at the entrance 142 includes a plurality of tines 144 with a plurality of gaps 146 positioned between the tines 144. The tines 144 and gaps 146 facilitate low resistance movement of the end of the propellant tube 92 within the propellant contained in the containment region 94 of the propellant hopper 50.

Figure 8:
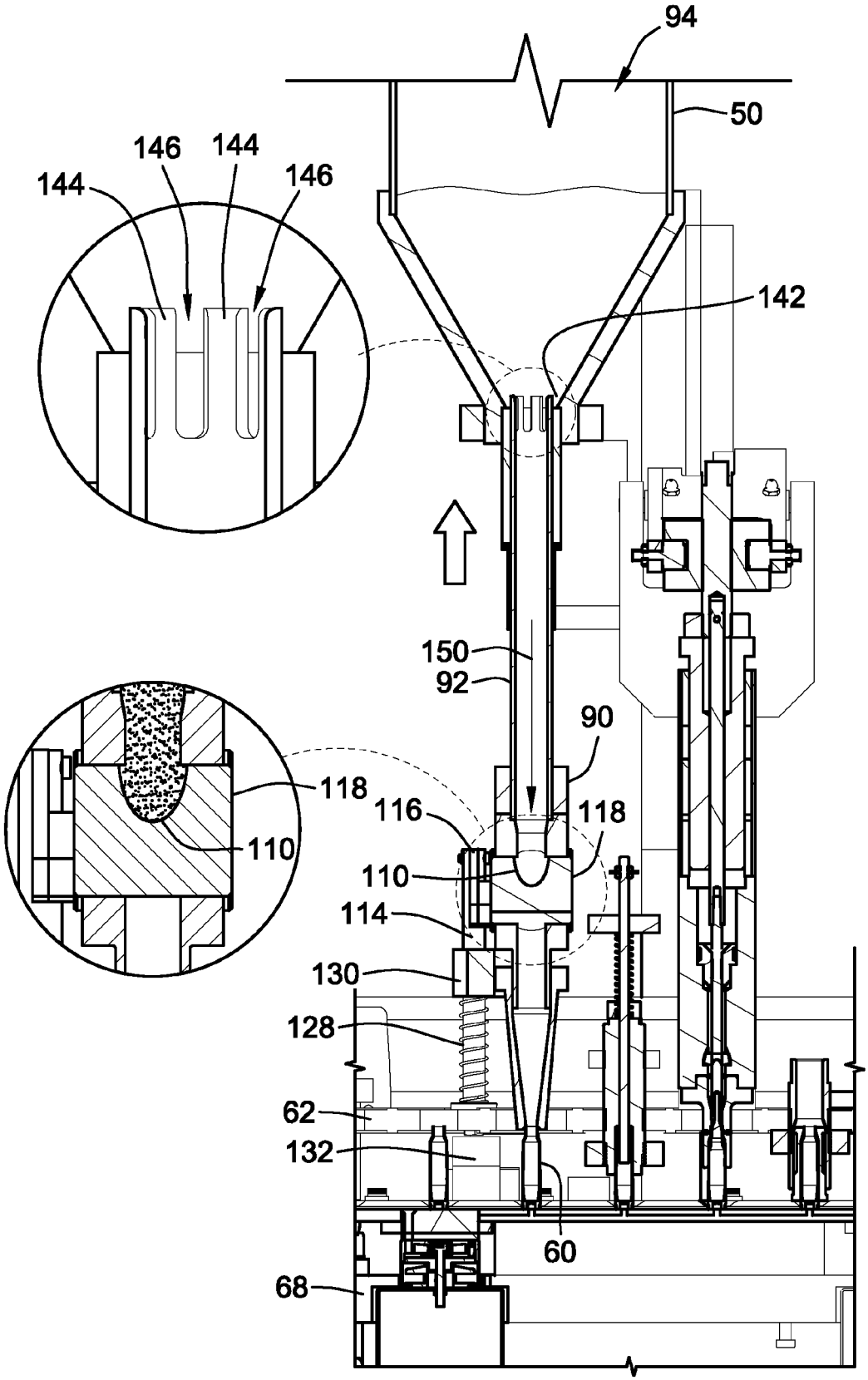

More specifically, and with reference now to FIG. 8, as the propellant tube 92 moves upward with the top plate 62 during the upward stroke, the same will move linearly and through the entrance 142 and into the containment region 94 of the propellant hopper 50. Additionally, the measuring cylinder 110 and carrying cylinder 118 will rotate under the action of the rocker arm 116 and abutment arm 114 as described above to align the measuring cylinder 110 with the propellant tube 92. In such a configuration, propellant is allowed to pass through the propellant tube 92 and into measuring cylinder 110 in direction 150 as illustrated. Also as shown in this view, the tines 144 and gaps 146 extend upward and into the containment region 94 to assist in transferring propellant from the propellant hopper 50 to the measuring cylinder 110. From inspection and comparison of FIG. 7 to FIG. 8, it will be recognized that the propellant hopper 50 remains stationary and the propellant tube 92 oscillates relative to the propellant hopper and into the containment region 94 to transfer propellant as described above. It will also be recognized that under normal operations the containment region 94 will be partially filled with propellant and the propellant tube 92 will be filled with a column of propellant. As such, the clearance between the carrying cylinder 118 and the remainder of the propellant delivery mechanism 90 is small enough to prevent the ingress of propellant between these components.

The stationary propellant hopper 50 may be provided in a variety of sizes and is not limited to the particular size illustrated. Further, the propellant hopper 50 can be made from an electrically insulating material so as to prevent the propagation of a static electric charge therethroughout. It will be recognized, however, that using a stationary propellant hopper 50 substantially reduces any build-up of any static electric charge within the stationary propellant hopper 50.

Having described the various attributes of the stationary propellant hopper 50 as well as the propellant delivery mechanism 90, a description will now be provided for the rake assembly 36 (see FIG. 1).

Figure 9:
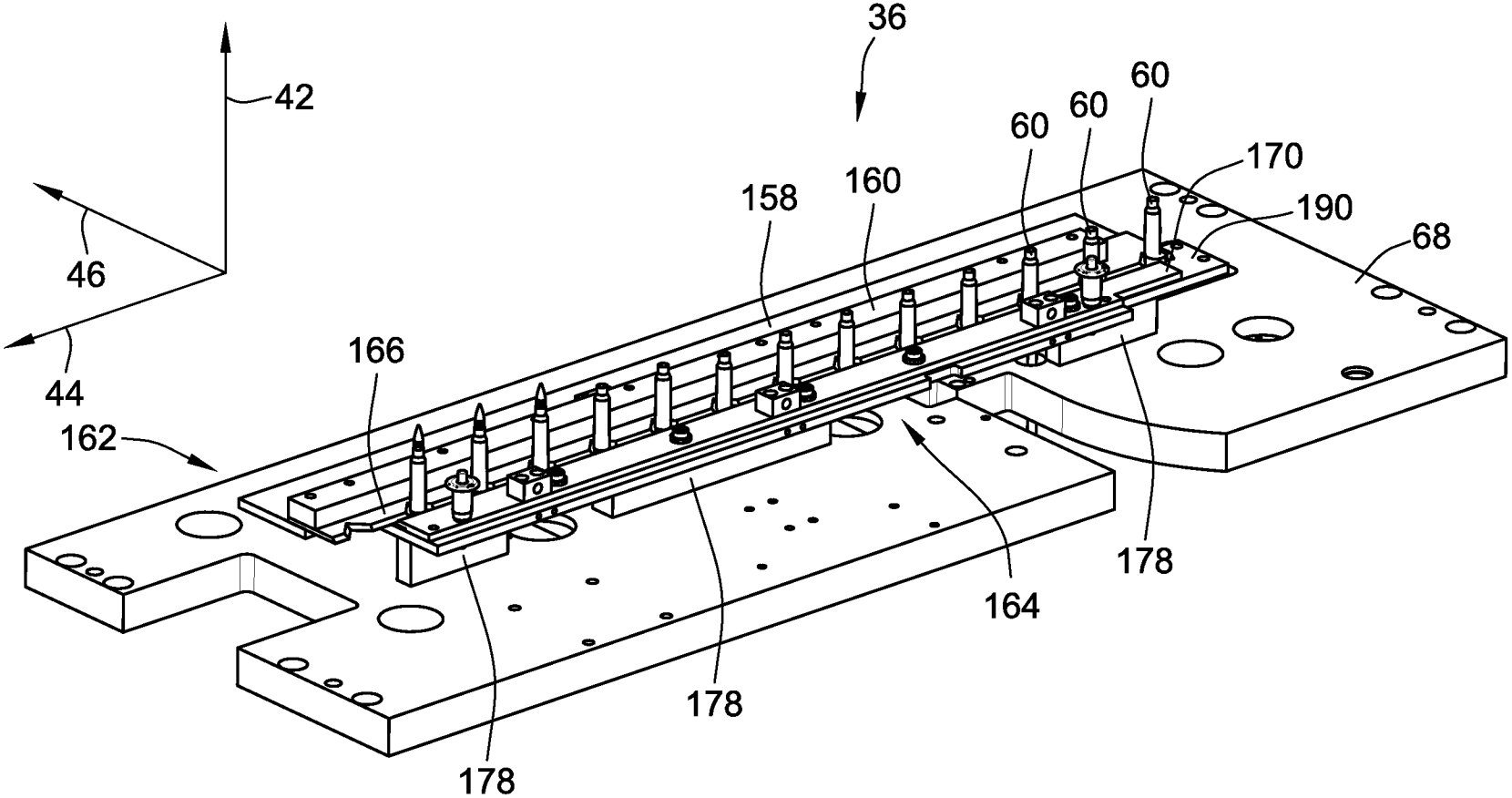
FIG. 9 is a perspective view of a rake assembly of the machine of FIG. 1.

With particular reference now to FIG. 9, the rake assembly 36 is illustrated. The rake assembly 36 includes first and second bar arrangements 162, 164 which work together to move the linear row of cases 60 parallel to the second reference axis 44 in FIG. 9. The rake assembly 36 is responsible for moving each case from right to left in FIG. 9 and through the various stations provided by the platen assembly 34 described above (see FIG. 1).

The rake assembly 36 is supported by the table top 68 via supports 178. The first bar arrangement 162 undergoes a generally reciprocating motion during operation to laterally move each case 60 from right to left in FIG. 9 and from station to station. The second bar arrangement 164 remains generally stationary and defines the linear path of the cases 60 as they move from left to right. That is, the cases 60 remain in abutted contact with the second bar arrangement 164, while the cases 60 will come into intermittent contact with the first bar arrangement 162 as it undergoes its reciprocating motion. The first bar arrangement 162 includes a mounting bar 160, a rake 166, an upper arm 158, and a lower arm 156 (see FIG. 15). The second bar arrangement includes a blade 170 positioned on top of a base 190.

Figure 10:
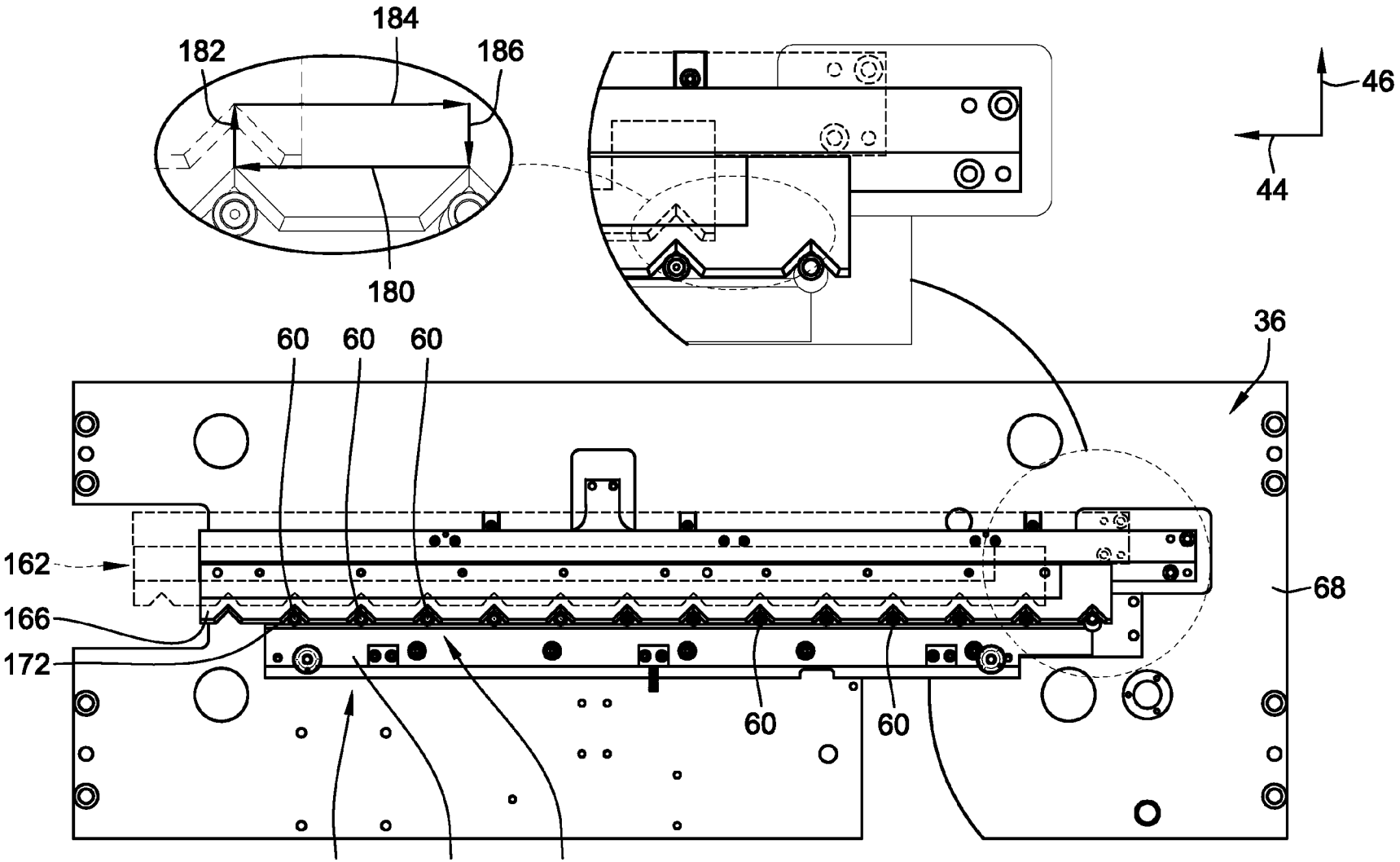
FIG. 10 is a top view of the rake assembly of FIG. 9.

Turning now to FIG. 10, the aforementioned reciprocating motion will be described in greater detail. The first bar arrangement 162 is mechanically coupled to the drive arrangement 38 (see FIG. 1) which is responsible for producing the reciprocating motion thereof. The first bar arrangement 162 includes a rake 166 that defines a plurality of notches or cut-outs 168 for receipt of a bottom portion of each case (see also FIG. 9). The notches 168 are generally triangular in shape. The notches are sized such that they can function with all sizes of calibers produced by the ammunition loading machine 30. It will be recognized by those skilled in the art that given the triangular shape of the notches 168 and the round shape of each case, larger calibers will extend out of each notch 168 to a greater extend than smaller calibers. In any case, however, the notches 168 make enough contact with the cases 60 such that they can move the same from station to station as described herein.

The notches 168 bias the cases 60 into contact with a leading or peripheral edge 172 of the blade 170 of the second bar arrangement 164. The notches 168 and peripheral edge 172 cooperate to allow the rake 166 to slide the row of cases 60 along the peripheral edge 172 of the blade 170 from right to left and parallel to the second reference axis 44 as illustrated in FIG. 10. This operation allows the first bar arrangement 162 to move the linear row of cases 60 relative to the second bar arrangement 164 to move each case 60 from one station to the next adjacent station.

The first bar arrangement 162 repeatedly makes the aforementioned movement of the cases 60 under a reciprocating motion. This motion includes four distinct steps. The first step has been described above and is the movement from right to left in FIG. 10 in the linear row of cases 60 from one station to a next adjacent station along a feed direction 180. Once this movement is complete, the first bar arrangement 162 then moves parallel to the third reference axis 46 along a back off direction 182 such that it is no longer in contact with the linear row of cases 60. That is, the notches 168 of the rake 166 no longer contain the cases 60. Once this motion is complete, the first bar arrangement 162 then moves parallel to the second reference axis 44 and from left to right in FIG. 10 along a first return direction 184. Once this motion is complete, the first bar arrangement then returns to its starting position along a second return direction 186.

At this point of the reciprocating cycle, the notches 168 again receive the linear row of cases 60. It will be recognized that the above described steps define a generally rectangular path of motion for the first bar arrangement 162. This cycle then repeats and the result is that each case 60 is moved from right to left in FIG. 10 and from station to station.

Figure 11:
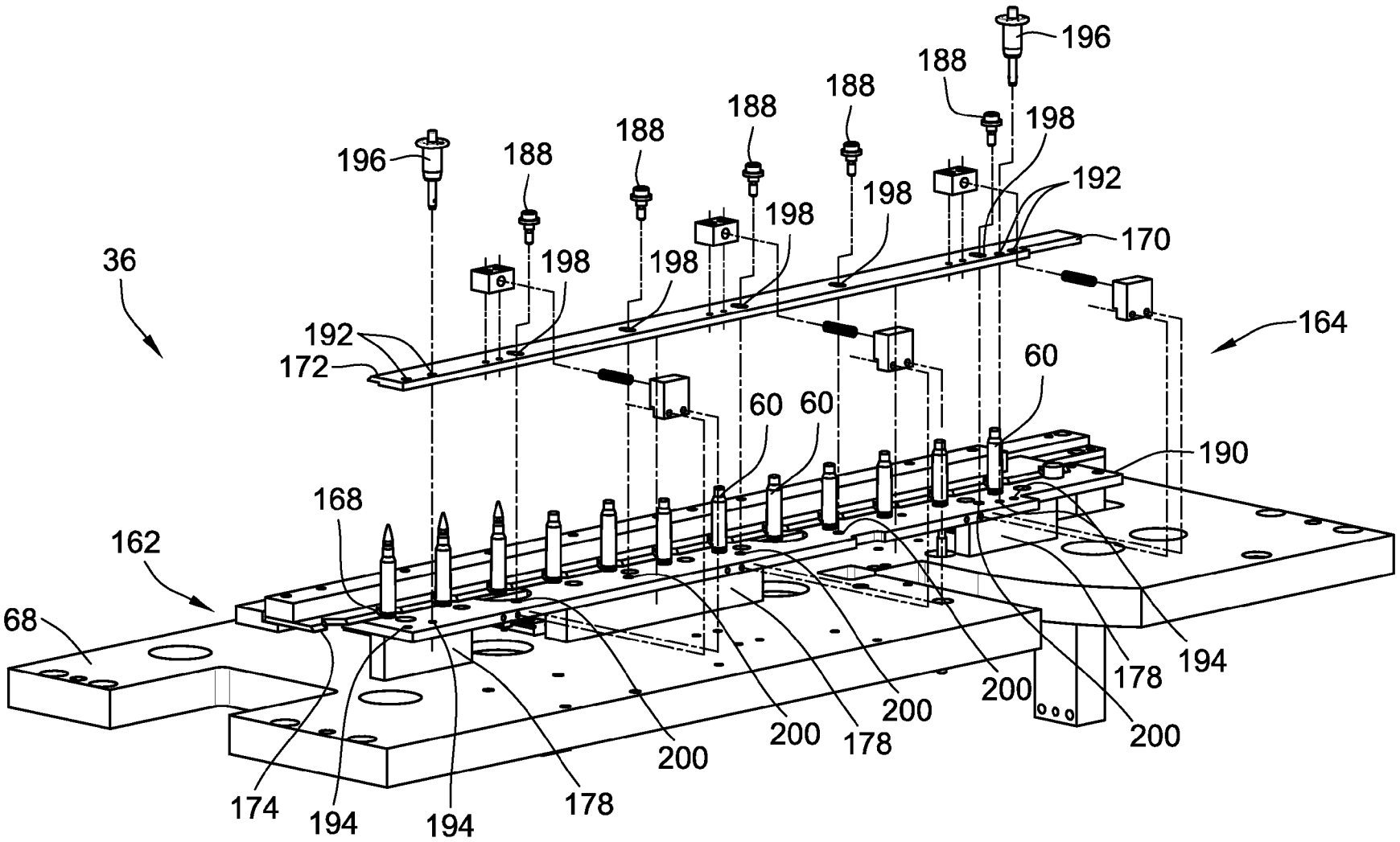
FIG. 11 is a perspective exploded view of the rake assembly of FIG. 9.

Turning now to FIG. 11, as stated previously the second bar arrangement 164 remains generally stationary while the first bar arrangement 162 undergoes its reciprocating cycle. However, and as will be explained in greater detail below, the second bar arrangement 164 is adjustable relative to the first bar arrangement 162 to vary a minimum distance between the peripheral edge 172 of the blade 170 and a peripheral edge 174 of the rake 166.

This minimum distance between these peripheral edges 172, 174 is present when the first bar arrangement 162 moves along the feed direction 180 (see FIG. 10). This minimum distance is variable and is governed by the particular caliber of cases 60 utilized. Those skilled in the art will recognize that the minimum distance will be larger for larger calibers and smaller for smaller calibers of cases 60. As such, the second bar arrangement 164, and more particularly the blade 170 is adjustable to a plurality of discrete adjustment positions relative to the first bar arrangement 162 to vary the minimum distance so that the reciprocating cycle of the first bar arrangement 162 need not be varied. Each one of the plurality of discrete adjustment positions defines a particular class of calibers that the rake assembly 36 can accommodate. For example, at one discrete adjustment position, the rake assembly 36 can accommodate caliber sizes ranging from about .22 caliber to about .50 caliber. It will be recognized that this range of calibers is not limiting on the invention and other ranges are possible depending on the particular configuration of the adjustability of the second bar arrangement 164.

Still referring to FIG. 11, the aforementioned adjustability of the second bar arrangement 164 is made possible by a plurality of adjustment apertures 192 formed in the blade 170 and corresponding adjustment apertures 194 formed in the base 190 of the second bar arrangement 164. The adjustment apertures 192, 194 define the aforementioned discrete adjustment positions of the second bar arrangement 164. For example, the inner most adjustment apertures 192 of the blade 170 align with the inner most adjustment apertures 194 of the base 190 to define one of the aforementioned discrete adjustment positions. Likewise, the outer most adjustment apertures 192 of the blade 170 in the outer most adjustment apertures 194 of the base 190 define another discrete adjustment position of the second bar arrangement 164. Alignment between the particularly selected adjustment apertures 192, 194 is maintained by way of a cam follower 196 which passes through both the blade 170 and the base 190 and the respectively adjustment apertures 192, 194 thereof. This cam follower selection functionality allows for the rapid reconfiguration of the blade assembly 36 between the various adjustment positions simply by removing the cam followers 196 realigning the adjustment apertures 192, 194, and replacing the cam followers 196.

The blade 170 is fastened by a plurality of fasteners 188. The fasteners 188 pass through slotted apertures 198 of the blade 170 and through circular apertures 200 formed in the base 190. It will be recognized that the slotted apertures 198 permit the blade 170 to slide relative to the base 190 with the fasteners 188 loosened but installed and the cam followers 196 removed. This functionality allows the blade 170 to remain mounted with the remainder of the second bar arrangement 164 yet allows the blade 170 to be quickly repositioned to a different discrete adjustment position. Thereafter, the cam followers 196 can be replaced within the newly aligned adjustment apertures 192, 194, and ammunition loading operations can continue at a new size of case.

Figure 12:
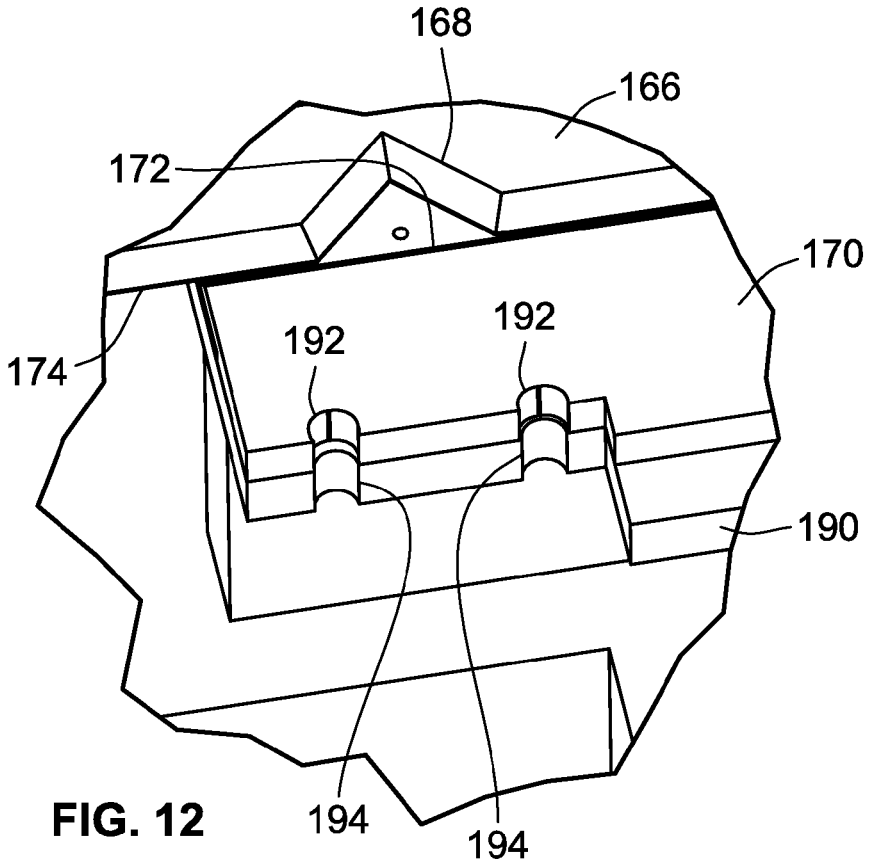
FIGS. 12-14 are partial cross sections of the rake assembly of FIG. 9.

FIG. 12 illustrates a close-up view of the apertures 192, 194 of the blade 170 and base 190 respectively. As illustrated, the right most apertures 192, 194 are aligned for receipt of the cam follower 196 (see FIG. 11). The left most apertures 192, 194 are not aligned and when they become aligned, they define a separate and discrete adjustment position from the right most apertures 192, 194 of FIG. 12.

Figure 13:
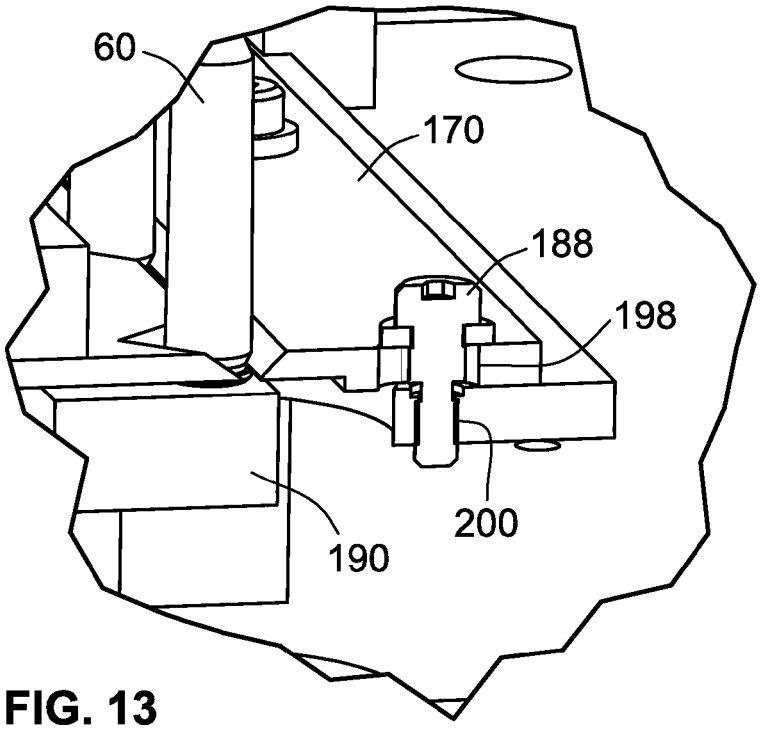

FIG. 13 is a close-up view of the fasteners 188 connecting the blade 170 to the base 190 by passing through the slotted apertures 198 of the blade 170 and the circular apertures 200 of the base 190. As described above, the slots 198 permit the blade 170 to slide relative to the base 190 for the adjustment thereof. Once the distinct adjustment position has been selected, the fasteners 188 are tightened to preserve the locational integrity of the blade 170 relative to the base 190.

Figure 14:
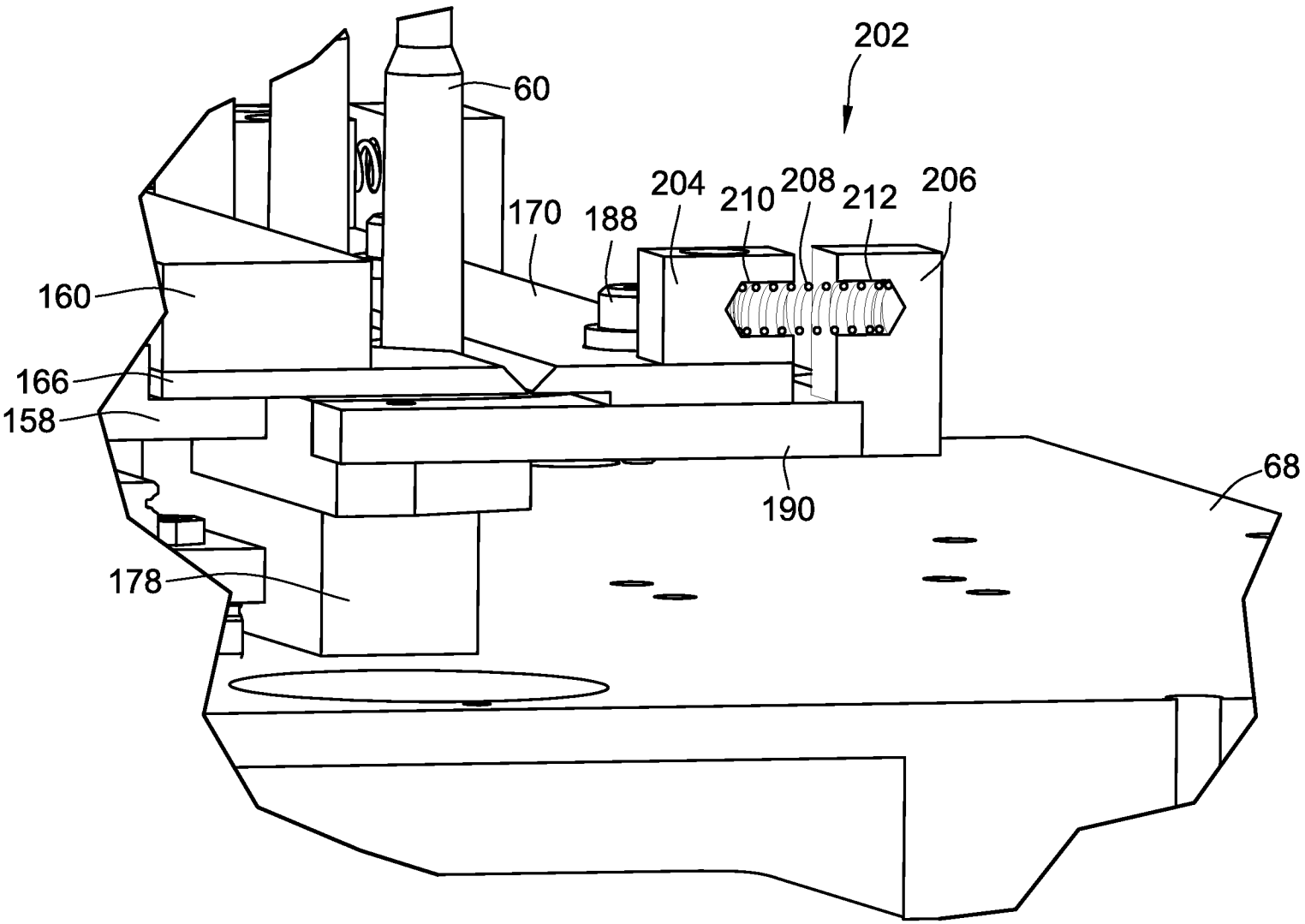

Turning now to FIG. 14, the blade 170 can also incorporate a biasing arrangement 202 in the form of spring blocks 204, 206 and a spring 208 positioned therebetween. The spring biasing arrangement 202 ensures the locational integrity of the blade 170 relative to the base 190. More specifically, when the rake 166 moves along the second return direction 186 (see FIG. 10) to engage the cases 60, such contact can produce a minor shift in the blade 170. To counteract this shift, the biasing arrangement 202 provides a sufficient return force to place the blade 170 back into its intended position.

To effectuate this functionality, one spring block 204 is mounted to the blade 170. The other spring block 206 is mounted to the base 190. The spring 208 is received by apertures 210, 212 formed in the spring blocks 204, 206 respectively.

Having described the assembly and operation of the second bar arrangement 164, a description will now be provided of the assembly of the first bar arrangement 162 with particular attention given to its mechanical connections to the drive arrangement 38 (see FIG. 1).

Figure 15:
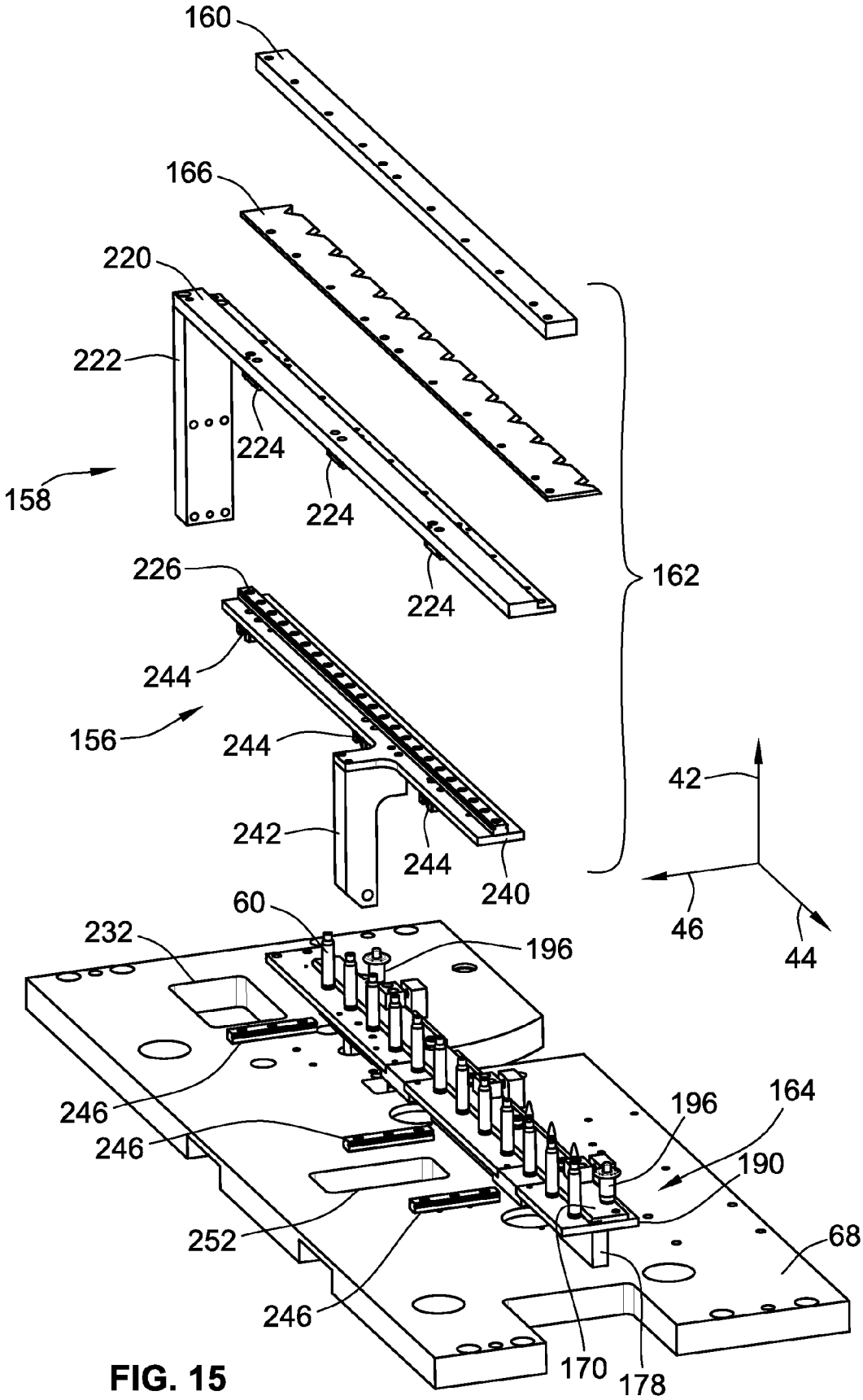
FIG. 15 is another exploded perspective view of the rake assembly of FIG. 9.

Turning now to FIG. 15, the rake 166 is positioned between the upper arm 158 and the mounting bar 160. The mounting bar 160, rake 166, and upper arm 158 include aligned apertures through which fasteners (not shown) pass to fixedly retain the rake 166 between the mounting bar 160 and the upper arm 158.

The upper arm 158 is generally L-shaped and includes a first member 220 and a second member 222 mounted generally perpendicularly to the first member 220. A plurality of bearing blocks 224 are mounted to an underside of the first member 220. The bearing blocks 224 are received by a bearing rail 226 mounted upon an upper surface of the lower arm 156. As a result, the upper arm 158 is slideable generally parallel to the second reference axis 44 relative to the lower arm 156.

The second member 222 of the upper arm 158 extends through an upper arm passageway 232 performed in the table top 68. As will be explained in greater detail below, the second member 222 extends through the upper arm passageway 232 and mechanically connects to the drive assembly 38 (see FIG. 1). In turn, the drive arrangement 38 (see FIG. 1) is responsible for sliding the upper arm 158, rake 166, and mounting bar 160 relative to the lower arm 156 to produce movement of the rake 166 in the feed direction 180 (see FIG. 10) as well as the first return direction 184 (see FIG. 10).

The lower arm 156 also includes a first member 240 and a second member 242 extending generally perpendicular to the first member 240. The first member includes a plurality of bearing blocks 244 on an underside thereof. The bearing blocks 244 are received by a plurality of bearing rails 246 mounted to the table top 68. As such, the lower arm 156 is slideable relative to the table top 68 in a direction parallel to the third reference axis 46.

The second member 242 extends through a lower arm passageway 252 formed in the table top 68. As will be explained in greater detail below, the second member 242 is mechanically coupled to the drive assembly 38 (see FIG. 1). This connection enables the movement of the upper arm 158 along the back off direction 182 (see FIG. 10) as well as the second return direction 186 (see FIG. 10).

By way of the interconnection of upper arm 158 to the lower arm 156 using bearing blocks 224 and bearing rail 226 as well as the connection of the lower arm 156 to the table top 68 using bearing blocks 244 and bearing rails 246, the upper arm 158 possesses two degrees of freedom (i.e. movement parallel to the second reference axis 44 and the third reference axis 46), and the lower arm 156 possesses one degree of freedom (movement parallel to the third reference axis 46). As a result of the above described configuration, movement of the rake 166 in each of the feed direction 180, back off direction 182, first return direction 184, and second return direction 186 (see FIG. 10) is possible.

Having described the configuration and operation of the platen assembly 34 and rake assembly 36 as well as their relative motions, a description will now be provided of the drive arrangement 38 which produces the above described motions.

Figure 16:
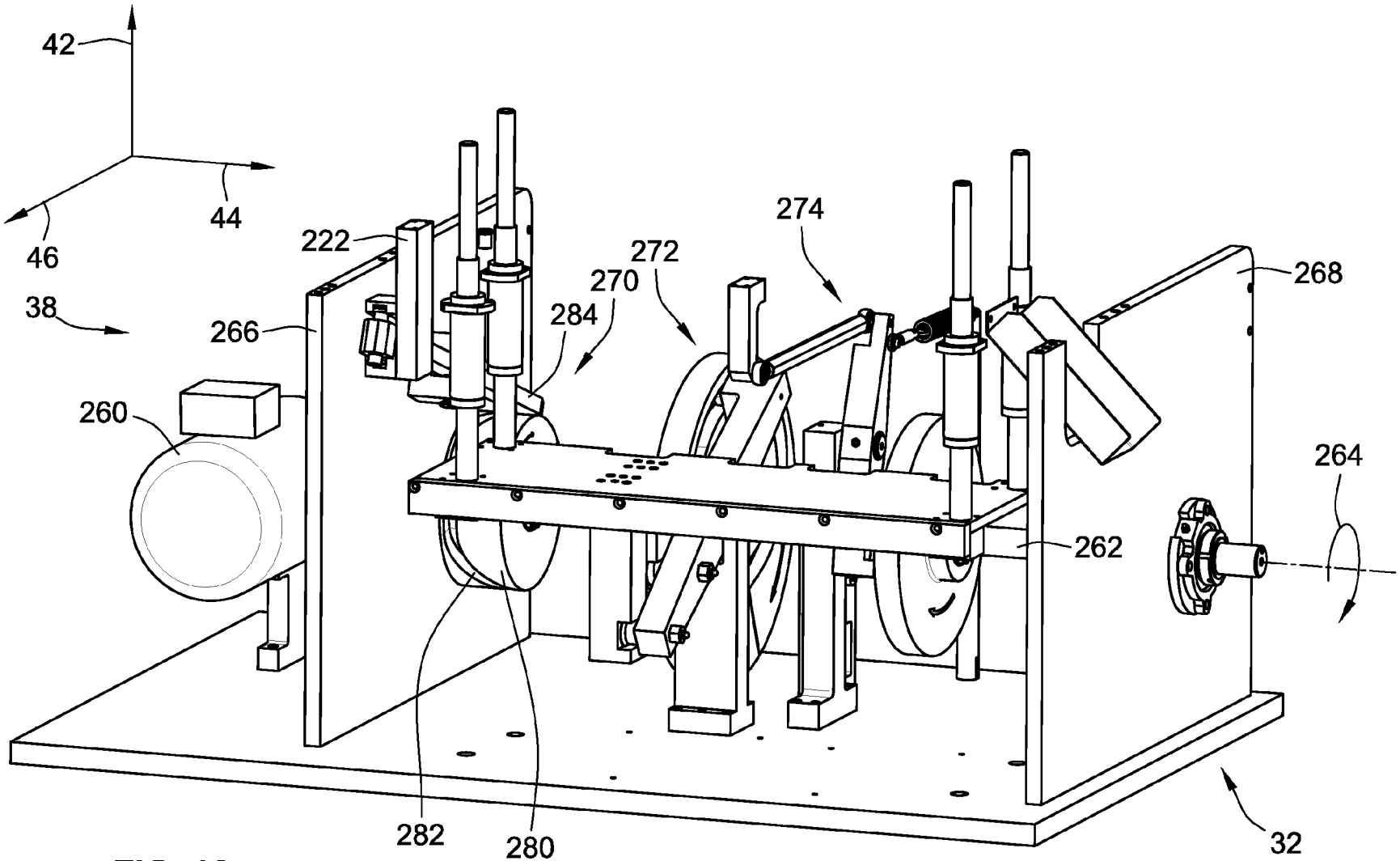
FIG. 16 is a perspective view of a drive arrangement of the ammunition loading machine of FIG. 1.

The drive arrangement 38 is illustrated at FIG. 16. The drive arrangement 38 includes a motor 260 responsible for rotating the drive shaft 40 (see FIG. 1) in rotational direction 264 to produce the above described motions of the platen assembly 34, and the rake assembly 36. The drive arrangement 38 presents a new and improved configuration over prior designs in that the same incorporates a unified drive shaft 40 responsible for producing all of the attended motions of the ammunition loading machine 30, unlike prior designs which require multiple shafts and multiple drive arrangements to produce the same.

The drive shaft 40 includes a plurality of cam arrangements in the form of a first cam arrangement 270, a second cam arrangement 272, and a third cam arrangement 274. Each of these cam arrangements 270, 272, 274 will be discussed in turn in the following.

The first cam arrangement 270 includes a barrel cam 280 fixedly mounted to the drive shaft 40 such that the barrel cam 280 rotates in rotational direction 264 commensurate with rotation of the drive shaft 40. The barrel cam 280 includes follower groove 282 formed in a radial face of the barrel cam 282. A reciprocating arm 284 is mechanically coupled to the barrel cam 280 as well as the second member 222 of the upper arm 158 (see FIG. 15). The rotation of the barrel cam 282 caused by rotation of the drive shaft 40 is transferred to linear motion of the upper arm 158 (see FIG. 15) in the feed direction 180 and the first return direction 184 (see FIG. 10).

Figure 17:
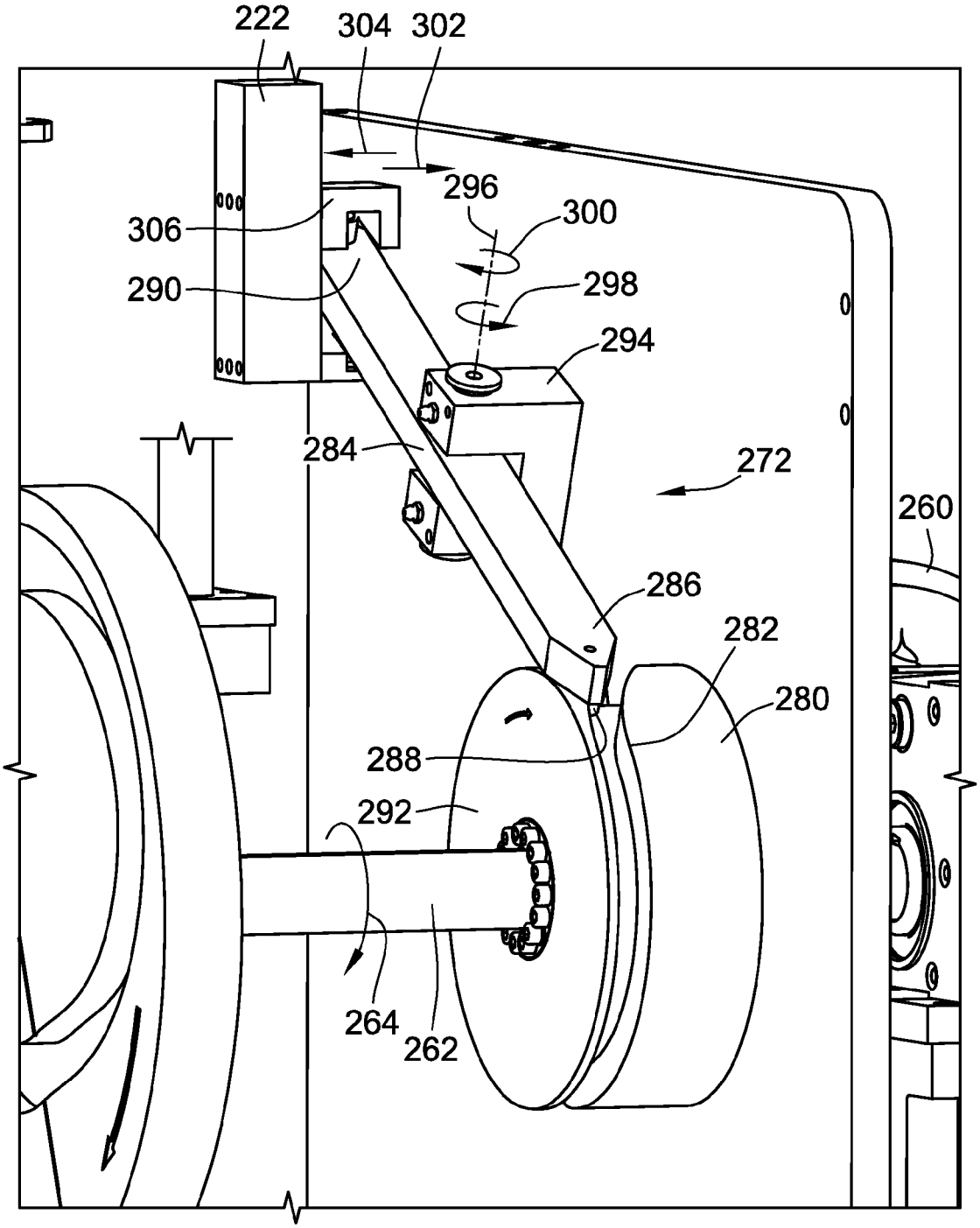
FIGS. 17-19 are partial perspective views of first, second, and third cam arrangements, respectively, of the drive arrangement of FIG. 16.

More specifically, and with reference now to FIG. 17, the reciprocating arm 284 has a first end 286 and a second end 290. A cam follower 288 extends from the first end 286 into the follower groove 282. The cam follower 288 is slideable within the follower groove 282. The axial distance from an outer face 292 of the barrel cam 280 to a center line of the follower groove 282 varies about the circumference of the barrel cam 280. This variance causes the distance of the cam follower 288 from the outer face 292 of the barrel cam 280 to also vary as the drive shaft 40 and barrel cam 280 rotate in rotational direction 264.

The reciprocating arm 284 is pivotably mounted to one of the side members 266 of the base frame 32 by way of a pivot block 294. This connection permits the reciprocating arm 284 to pivot about an axis 296 defined by the pivot block 294 in rotational directions 298, 300 as illustrated.

More specifically, as the first end 286 and cam follower 288 approach a minimum axial distance from the outer face 292 of the barrel cam 280, the reciprocating arm 284 will rotate in rotational direction 300 to displace the second end 290 thereof in linear direction 302. When the second end 290 of the reciprocating arm 280 moves in the linear direction 302 as illustrated, so too shall the second member 222 of the upper arm 158 (see FIG. 15). This motion results in movement in a direction parallel to the second reference axis 44 (see FIG. 15), i.e. in the first back off direction 184 (see FIG. 10).

Similarly, as the first end 286 and cam follower 288 move away from the outer face 292 of the barrel cam 280, the reciprocating arm 284 will rotate in rotational direction 298 about axis 296. Such movement causes the second end 290 of the reciprocating arm 284 to move in linear direction 304 as illustrated. When the second end 290 moves in linear direction 304, so to shall the second member 222 of the upper arm 156 (see FIG. 15). This movement of the second member 222 in linear direction 304 is parallel to the second reference axis 44, i.e. in the feed direction 180 (see FIG. 10).

The second member 222 is mounted to the second end 290 of the reciprocating arm 284 by way of a shoulder mount 306. The shoulder mount 206 presents a rotational sliding joint relative to the second member 222 such that the second member 222 does not rotate about its longitudinal centroidal axis during movement in the linear directions 302, 304. As such, rotation of the barrel cam 280 is transferred into pure linear movement of the second member 222 as well as the remainder of the upper arm 158 (see FIG. 15).

Figure 18:
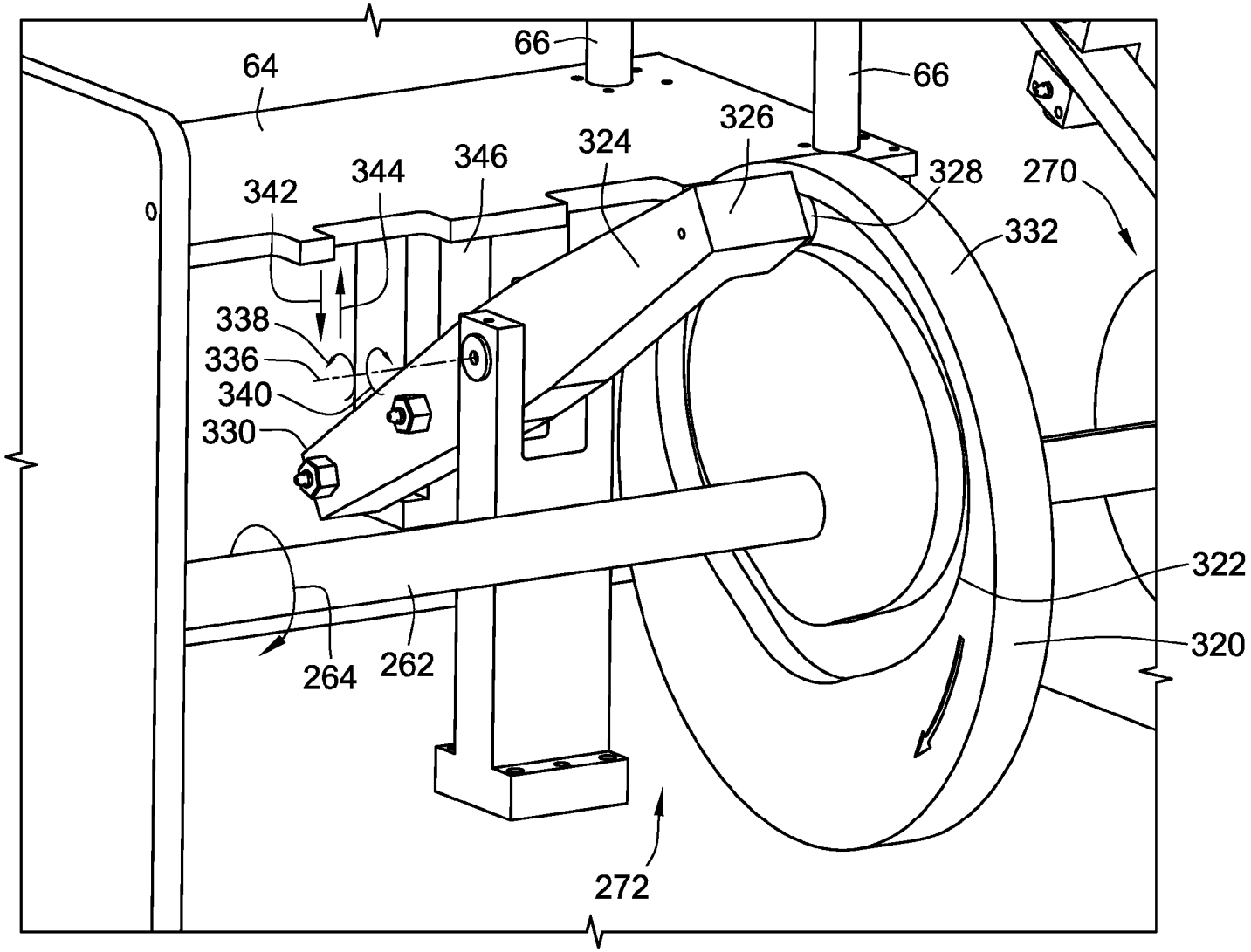

Turning now to FIG. 18, the second cam arrangement 272 will be described in greater detail. The second cam arrangement 272 is responsible for producing the upward and downward movement of the platen assembly 34 (see FIG. 1) in a direction parallel to the first reference axis 42 (see FIG. 1). The second cam arrangement 274 includes a face cam 320. The face cam 320 includes a follower groove 322 formed in an axial face of the face cam 320 as illustrated. The face cam 320 is fixedly mounted to the drive shaft 40 such that rotation of the drive shaft 40 in rotational direction 264 produces a commensurate rotation in the face cam 320.

The cam arrangement 274 also includes a reciprocating arm 324. The reciprocating arm 324 includes a first end 326 and a second end 330. A cam follower 328 is mounted at the first end 326 of the reciprocating arm 324. The cam follower 328 extends into the follower groove 322 of the face cam 320 and is slideable therein. The second end 330 of the reciprocating arm 324 is connected via a cam follower joint to a linkage block 346. The linkage block 346 is fixedly connected to the bottom plate 64 of the platen assembly 34 (see also FIG. 1). The reciprocating arm 324 is also coupled at an intermediary point between the first and second ends 326, 330 to a pivot block 334 that defines a pivot axis 336, which the reciprocating arm 324 can pivot about as described below.

The follower groove 332 is irregular in shape and is eccentric relative to base cam 320. As illustrated a distance from an outer radial face 332 of the face cam 320 and a center line of the follower groove 322 varies about the circumference of the face cam 320. As the distance between the outer radial face 332 and the center line of the follower groove 322 decreases, the reciprocating arm 324 will rotate about the axis 336 of the pivot block 334 in rotation direction 338. This movement of the reciprocating arm 324 will in turn pull the linkage block 346 downward in linear direction 342. Movement of the linkage block 346 in linear direction 342 also results in the movement of the bottom plate 64 in linear direction 342. As described above, the bottom plate 64 is fixedly connected to the top plate 62 of the platen assembly 34 by supports 66. The supports 66 are also fixedly connected to the bottom plate 64. As a result, movement of the bottom plate 64 in linear direction 342 ultimately results in the platen assembly 34 moving in its downward stroke to perform the various operations on the linear row of cases 60 (see FIG. 1).

As the distance between the outer radial face 332 of the face cam 320 and the center line of the power groove 322 increases, the reciprocating arm 324 will rotate about axis 396 of the pivot block 334 in direction 340. This rotation of the reciprocating arm 324 causes the linkage block 346 to move in linear direction 344 as a result of the cam follower connection between the second end 330 of the reciprocating arm 324 and the linkage block 346. Movement of the linkage block 346 in linear direction 344 causes the bottom plate 64, supports 66 and top plate 62 (see FIG. 1) of the platen assembly 34 to move in linear direction 344 as well to ultimately move the platen assembly 344 upward and away from the linear row of cases 60. Once the top plate 62 of the platen assembly 34 has cleared the linear row of cases 60, the rake assembly 36 can index the linear row of cases 60 such that each cases 60 is moved to its next adjacent station.

Still referring to FIG. 18, the linkage block 46 has a fixed length. As such, the stroke length of the platen assembly 34 (see FIG. 1), can be manipulated by exchanging the linkage block 346 with a shorter or longer linkage block as needed. Alternatively, the linkage block can include multiple mounting locations for connection to the reciprocating arm 324 to vary stroke lengths. This functionality allows for the rapid modification of stroke length by exchanging a single part. Such functionality is particularly advantageous when moving from shorter length ammunition to longer length ammunition.

Figure 19:
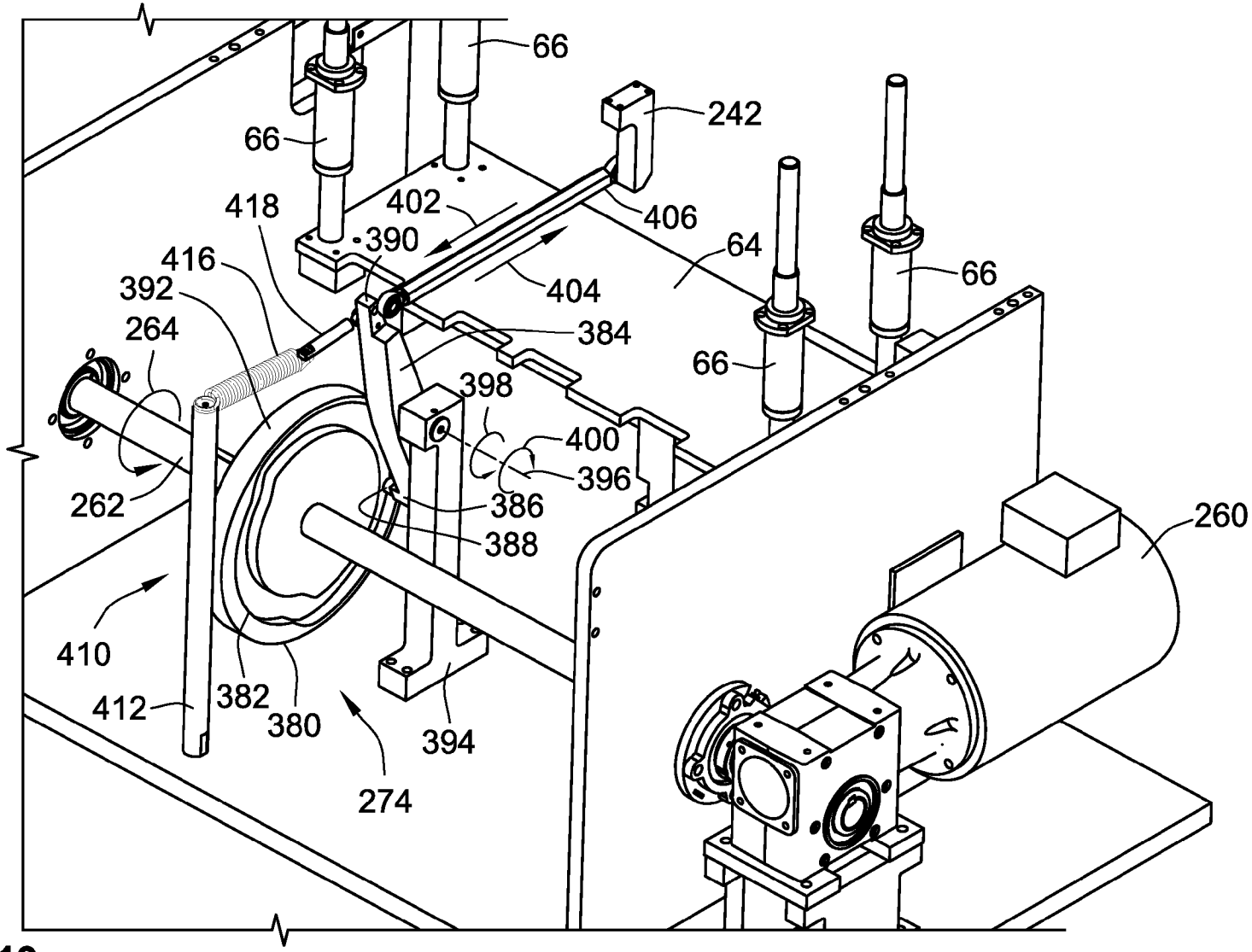

Turning now to FIG. 19, the third cam arrangement 274 is illustrated. The third cam arrangement 274 is responsible for producing the motion of the first bar arrangement 162 (see FIG. 15) in the back off direction 182 (see FIG. 10) as well as the second return direction 186 (see FIG. 10). The third cam arrangement 274 includes a face cam 380. The face cam 380 has a follower groove 382 formed in an axial face thereof. The third cam arrangement 274 also includes a reciprocating arm 384. The reciprocating arm 384 has a first end 386 and a second end 390. A cam follower 388 extends from the first end 386 and into the follower groove 382. The second end 390 is connected to a linkage rod 406 via a cam follower connection. The reciprocating arm 384 is connected at an intermediary location between the first and second ends 386, 390 to a pivot block 394. The pivot block 394 defines an axis 396 about which the reciprocating arm 384 can rotate.

The second cam arrangement 274 also includes a biasing arrangement 410. The biasing arrangement 410 includes a support rod 412. A spring 416 is coupled to an end of the support rod 412 as illustrated. The spring 416 is coupled at an opposite end thereof to a linkage 418. The linkage, in turn, is coupled to the second end 390 of the reciprocating arm 384. The biasing mechanism 410 is thus operable to pull the second end 390 to rotatably bias the reciprocating arm 384 about axis 396 in rotational direction 400. Continued rotation of the reciprocating arm 384 about axis 396 is prevented by way of the abutment of cam follower 388 with the radially outer most face of the follower groove 382 as illustrated.

The follower groove 382 is irregularly shaped. A radial distance between a radial outer face 392 of the face cam 380 and a center line of the follower groove 382 will vary about the circumference of the face cam 380. When this distance decreases, the biasing arrangement 410 will operate to rotate the reciprocating arm 384 about axis 396 in rotational direction 398. Rotation about axis 396 in rotational direction 398 causes the linkage rod 406 to linearly move along linear direction 404. The second member 242 of the lower arm 156 is connected at an end of the linkage rod 406. As a result, movement of the linkage rod 406 in linear direction 402 also results in movement of the second member 242 in linear direction 402. This movement of the second member 242 of the lower arm 156 ultimately results in the movement of the lower arm 156 in the second return direction 186 (see FIG. 10).

When the distance between the radial face 392 of the face cam 380 and the center line of the follower groove 382 increases, the reciprocating arm 384 will pivot against the biasing force from the biasing arrangement 410 about axis 396 in rotational direction 400. Movement of the reciprocating arm 384 in rotational direction 400 about axis 96 also causes the linkage rod 406 to move in linear direction 404. Movement of the linkage rod 406 in linear direction 404 also results in movement of the second member 242 of the lower arm 156 to move in linear direction 404. This ultimately causes the lower arm 156 to move in the back off direction 182 (see FIG. 10).

As described herein, the embodiments of the ammunition loading machine 32 overcome existing problems in the art by providing an apparatus that reduces power consumption and static electricity build-up as well as propellant compaction by incorporating a stationary propellant hopper. The ammunition loading machine 32 as described herein also overcome existing problems in the art by performing multiple weighing operations such that a quality control step is performed for every single round produced by the ammunition loading machine 32. The ammunition loading machine 32 also overcomes existing problems in the art by incorporating a rake assembly that can rapidly be reconfigured without disassembly to accommodate larger or smaller calibers by providing several discrete adjustment positions. Finally, the ammunition loading machine 32 presents a more streamlined drive arrangement 38 by incorporating a single drive shaft 40 and a plurality of cam arrangements 270, 272, 274 mounted to this common drive shaft 40.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An ammunition loading machine, comprising:

an articulated rake assembly for indexing cases mounted to a base frame;

a drive arrangement mounted to the base frame;

a platen assembly movable relative to the base frame along a longitudinal platen axis;

wherein each of the rake assembly and platen assembly are mechanically coupled to the drive arrangement for movement thereby;

a stationary propellant hopper fixedly mounted to the base frame and configured for carrying and supplying propellant to a propellant filling mechanism on the platen assembly; and wherein the platen assembly is movable relative to the stationary propellant hopper such that the platen assembly is configured to transfer propellant from the stationary propellant hopper to the propellant filling mechanism on the platen assembly.

2. The machine of claim 1, wherein the platen assembly includes a propellant filling station, the propellant filling station including a propellant tube, the propellant tube including a first end extending into a funnel of the stationary propellant hopper through an opening of the funnel, and a second end positioned adjacent a measuring cylinder of the propellant filling station, wherein the propellant tube oscillates parallel to the platen axis within the opening of the funnel.

3. The machine of claim 2, wherein the second end includes a plurality of tines separated by gaps.

4. The machine of claim 2, further comprising an L-shaped mounting arm for mounting the stationary propellant hopper to the base frame and above the propellant filling station.

5. The machine of claim 2, further comprising a first weighing station and a second weighing station positioned on the base frame, the first weighing station positioned on one side of the propellant filling station, the second weighing station positioned on another side of the propellant filling station such that a weight measurement is taken before and after propellant is dispensed from the propellant hopper.

6. The machine of claim 1, wherein the articulated rake assembly mounted to the base frame is moveable along first and a second axis, the first and second axes orthogonal and coplanar wherein the rake assembly comprises a first and a second bar arrangement, the first bar arrangement movable relative to the second bar arrangement to index a linear row of cases relative to the base frame along the first axis, wherein the second bar arrangement is adjustable along the second axis to vary a minimum distance between a peripheral edge of the first bar arrangement and a peripheral edge of the second bar arrangement.

7. The machine of claim 6, wherein the second bar arrangement includes a base and a blade, the blade mounted on top of the base and adjustable relative to the base, each of the blade and base having a plurality of adjustment apertures, wherein select ones of the plurality of adjustment apertures of the blade are alignable with select ones of the plurality of adjustment apertures of the base to define a plurality discrete adjustment positions.

8. The machine of claim 7, further comprising at least one biasing mechanism mounted between the blade and the base, the at least one biasing mechanism operable to bias the blade relative to the base along the second axis.

9. The machine of claim 1, wherein the articulated rake assembly mounted to the base frame is movable along first and a second axis, the first and second axes orthogonal and coplanar, and wherein each of the rake assembly and platen assembly are mechanically coupled to the drive arrangement for movement along the respective first, second, and platen axes.

10. The machine of claim 9, wherein the drive arrangement includes a drive shaft with first, second, and third cam arrangements mounted to the drive shaft, the first cam arrangement mechanically coupled to the rake assembly, the second cam arrangement mechanically coupled to the platen assembly, and the third cam arrangement mechanically coupled to the rake assembly.

* * * * *